US009907989B2

(12) United States Patent
Louviere

(10) Patent No.: US 9,907,989 B2
(45) Date of Patent: Mar. 6, 2018

(54) EXERCISE DEVICE FOR STRENGTHENING ABDOMINAL MUSCLES

(71) Applicant: Bentley Louviere, Luling, LA (US)

(72) Inventor: Bentley Louviere, Luling, LA (US)

( * ) Notice: Subject to any disclaimer, the term of this patent is extended or adjusted under 35 U.S.C. 154(b) by 0 days.

(21) Appl. No.: 14/333,171

(22) Filed: Jul. 16, 2014

(65) Prior Publication Data

US 2015/0024909 A1 Jan. 22, 2015

Related U.S. Application Data

(60) Provisional application No. 61/846,693, filed on Jul. 16, 2013.

(51) Int. Cl.

| | |
|---|---|
| ***A63B 21/06*** | (2006.01) |
| ***A63B 21/065*** | (2006.01) |
| ***A63B 21/00*** | (2006.01) |
| ***A63B 71/00*** | (2006.01) |
| ***A63B 23/02*** | (2006.01) |
| *A63B 21/055* | (2006.01) |
| *A63B 21/16* | (2006.01) |

(52) U.S. Cl.

CPC ..... *A63B 21/06* (2013.01); *A63B 21/0004* (2013.01); *A63B 21/4015* (2015.10); *A63B 23/0211* (2013.01); *A63B 23/0216* (2013.01); *A63B 21/0552* (2013.01); *A63B 21/1654* (2013.01); *A63B 21/1663* (2013.01)

(58) Field of Classification Search

CPC . A63B 23/0205; A63B 23/0211; A63B 21/04; A63B 21/06; A63B 21/072; A63B 21/08; A63B 21/4015; A63B 21/0615; A63B 21/0722; A63B 21/0724; A63B 21/0726; A63B 23/0216; A63B 23/0222; A63B 23/0227; A63B 2023/006; A63B 21/068; A63B 21/0004; A63B 23/02

USPC ..... 482/49, 140

See application file for complete search history.

(56) References Cited

U.S. PATENT DOCUMENTS

| | | | | |
|---|---|---|---|---|
| 4,183,520 | A | 1/1980 | Chase | |
| 4,314,697 | A | 2/1982 | Brumfield et al. | |
| 4,468,022 | A | 8/1984 | Wu | |
| 4,508,335 | A | 4/1985 | Kelley et al. | |
| 4,807,873 | A * | 2/1989 | Naquin | 482/105 |
| 5,346,447 | A | 9/1994 | Stearns | |
| 5,372,558 | A * | 12/1994 | Perry et al. | 482/49 |
| 5,941,806 | A | 8/1999 | Olschansky et al. | |
| 6,875,161 | B1 * | 4/2005 | Brice | 482/107 |
| 7,662,077 | B1 * | 2/2010 | Liu | 482/142 |
| 2002/0119872 | A1 * | 8/2002 | Greenheck | 482/93 |
| 2004/0180764 | A1 * | 9/2004 | Patton | 482/110 |
| 2008/0058173 | A1 * | 3/2008 | Mattox | 482/92 |
| 2010/0029449 | A1 * | 2/2010 | Kim | 482/121 |
| 2011/0224055 | A1 * | 9/2011 | Kassel | 482/121 |

FOREIGN PATENT DOCUMENTS

| | | |
|---|---|---|
| EP | 2455136 | 5/2012 |

* cited by examiner

*Primary Examiner* — Nyca T Nguyen
(74) *Attorney, Agent, or Firm* — Lee & Hayes, PLLC

(57) ABSTRACT

An exercise device includes an arrangement of components to strengthen muscles in a physical body of an individual. In particular, the exercise device can be used to perform exercised to strengthen at least abdominal muscles.

11 Claims, 19 Drawing Sheets

EXERCISE DEVICE FOR STRENGTHENING ABDOMINAL MUSCLES

PRIORITY CLAIM AND CROSS-REFERENCE TO RELATED APPLICATION

This application claims the benefit of, and priority to, U.S. Provisional Patent Application No. 61/846,693, filed Jul. 16, 2013, which is incorporated by reference herein in its entirety. horizontal

BACKGROUND

Exercise can be defined as any activity which requires a significant amount of exertion, either physical or mental. Mental exercise affects the brain, and can change the mental capabilities of the exerciser if done over a significant period of time. Physical exercise affects the physical body through movement of the body. There are two primary groups of physical exercise which can be performed by a person; aerobic, and anaerobic. Aerobic exercise focuses on improving the cardiovascular system and increasing endurance, such as swimming, running, cycling, and rowing. Anaerobic exercise focuses on strengthening the muscles which can increase muscle mass and thereby increase the amount of force the muscles are capable of applying to an object. Some good examples of anaerobic exercises include lifting weights, pushups, pull-ups, crunches, and reverse crunches.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
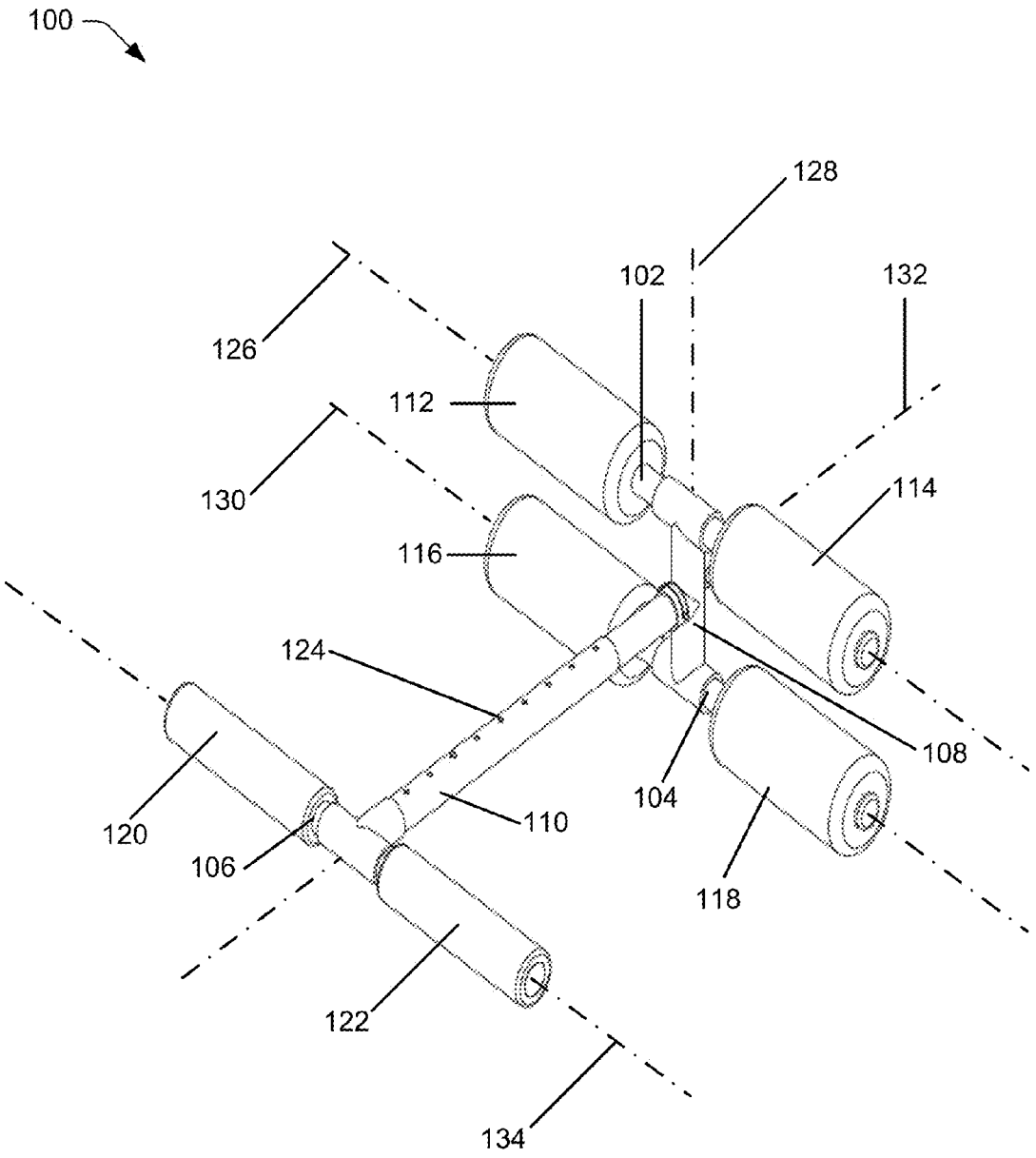
FIG. 1 is a perspective view of an embodiment of an exercise device.

This disclosure is directed to an exercise device to strengthen muscles in a physical body of an individual. In particular, the disclosure is directed to an exercise device that can strengthen at least abdominal muscles. In some instances, other muscles can be strengthened through the use of the exercise device described herein, such as leg muscles and back muscles. For example, the embodiments of the exercise device described herein can be used to perform reverse crunches. Reverse crunches can be performed by an individual lying on their back and then lifting their legs and lower body. In various instances, the reverse crunches can be performed without an individual separating their arms and upper body from the surface upon which they are laying.

Embodiments of the exercise device described herein can enhance abdominal strengthening exercises, such as reverse crunches, through both increased resistance to the motion, and increased stabilization of the motion of the exercise. In some cases, the exercise can be performed without additional weights, additional resistance, or additional equipment. In these situations, the weight of the legs and the exercise device provide the primary resistance to strain the muscles and cause them to strengthen over time. In other situations, abdominal strengthening exercises can be performed with additional weights and/or additional resistance. For example, the exercise device can be coupled with an exercise apparatus that includes weights (e.g., a weight rack) and exercises performed using the exercise device can utilize the weights of the exercise apparatus. In another example, weights can be coupled directly to the exercise device and exercises can be performed utilizing the additional weight coupled to the exercise device.

By performing exercises with embodiments of the exercise device described herein, an individual can perform exercises using the same or similar technique as the exercise would be performed without the exercise device, but with improved strengthening of the physical body of the individual due to the increased weight and/or resistance provided by using the exercise device and due to the structure of the exercise device. To illustrate, performing reverse crunches using embodiments of the exercise device described herein can improve strengthening of abdominal muscles. In addition, performing exercises, such as reverse crunches, using embodiments of the exercise device described herein can minimize the strain exerted on lower back muscles. In this way, individuals having back injuries can perform exercises using embodiments of the exercise device described herein without the discomfort that occurs when performing the exercises conventionally. Furthermore, the embodiments of the exercise device described herein are relatively lightweight for ease of transport and the exercise device can be configurable to be used by individuals of differing body types and sizes and for different types of exercises.

All illustrations of the drawings are for the purpose of describing embodiments of an exercise device herein and are not intended to limit the scope of the features of the embodiments of the exercise device.

FIG. 1 is a perspective view of an embodiment of an exercise device 100. The exercise device 100 can include a first bar member 102, a second bar member 104, and a third bar member 106. The first bar member 102 can be attached to the second bar member 104 using a first connection member 108. Additionally, the exercise device 100 can include a second connection member 110 to attach the third bar member 106 to the first bar member 102 and the second bar member 104. In some cases, the first connection member 108 can be coupled to the second connection member 108 to attach the third bar member 106 to the first bar member 102 and the second bar member 104.

In an embodiment, the exercise device 100 can also include a number of pads. For example, in the illustrative example of FIG. 1, the exercise device 100 can include a first pad 112 and a second pad 114 for the first bar member 102 and a third pad 116 and a fourth pad 118 for the second bar member 104. Additionally, the exercise device 100 can include a fifth pad 120 and a sixth pad 122 for the third bar member 106. The pads 112, 114, 116, 118, 120, 122 can be comprised of a suitable material to cushion the physical body of an individual using the exercise device 100 from contact with the first bar member 102, the second bar member 104, the third bar member 106, or a combination thereof. In some cases, the respective materials of at least two of the pads 112, 114, 116, 118, 120, 122 can be substantially the same. In other instances, the respective materials of at least two of the pads 112, 114, 116, 118, 120, 122 can be different.

The first bar member 102, the second bar member 104, and the third bar member 106 can be hollow having an outer diameter and an inner diameter that is less than the outer diameter. In some cases, the first bar member 102, the second bar member 104, the third bar member 106, or a combination thereof, can have a relatively smooth inner diameter. In other cases, the inner diameter of the first bar member 102, the second bar member 104, the third bar member 106, or a combination thereof, can be at least partially threaded.

In an embodiment, the outer diameter and/or the inner diameter of the first bar member 102, the second bar member 104, and the third bar member 106 can be approximately the same. In other instances, the outer diameter and/or the inner diameter of one or more of the first bar member 102, the second bar member 104, or the third bar member 106 can be different. For example, the first bar member 102 can have a different outer diameter and/or inner diameter than the second bar member 104 and/or the third bar member 106. In another example, the second bar member 104 can have a different outer diameter and/or inner diameter than the first bar member 102 and/or the third bar member 106. In some situations, the outer diameter and/or the inner diameter of the first bar member 102, the second bar member 104, the third bar member 106, or a combination thereof can be substantially uniform over a length of the respective member. In other instances, the outer diameter and/or the inner diameter of the first bar member 102, the second bar member 104, the third bar member 106, or a combination thereof can vary over a length of the respective member.

In various embodiments, the outer diameter of the first bar member 102, the second bar member 104, the third bar member 106, or a combination thereof, can be at least about 0.4 inches, at least about 0.7 inches, at least about 1 inch, or at least about 1.4 inches. Additionally, the outer diameter of the first bar member 102, the second bar member 104, the third bar member 106, or a combination thereof, can be no greater than about 3 inches, no greater than about 2.6 inches, no greater than about 2.1 inches, no greater than about 1.6 inches, or no greater than about 1.1 inches. In an illustrative example, the outer diameter of the first bar member 102, the second bar member 104, the third bar member 106, or a combination thereof, can be included in a range of about 0.3 inches to about 3.5 inches. In another illustrative example, the outer diameter of the first bar member 102, the second bar member 104, the third bar member 106, or a combination thereof, can be included in a range of about 0.5 inches to about 1.5 inches. In an additional illustrative example, the outer diameter of the first bar member 102, the second bar member 104, the third bar member 106, or a combination thereof, can be included in a range of about 1.5 inches to about 2.5 inches.

In some embodiments, the inner diameter of the first bar member 102, the second bar member 104, the third bar member 106, or a combination thereof, can be at least about 0.2 inches, at least about 0.5 inches, at least about 0.8 inches, or at least about 1.1 inches. Additionally, the inner diameter of the first bar member 102, the second bar member 104, the third bar member 106, or a combination thereof, can be no greater than about 2.6 inches, no greater than about 2.1 inches, no greater than about 1.7 inches, or no greater than about 1.3 inches. In an illustrative example, the inner diameter of the first bar member 102, the second bar member 104, the third bar member 106, or a combination thereof, can be included in a range of about 0.3 inches to about 2.8 inches. In another illustrative example, the inner diameter of the first bar member 102, the second bar member 104, the third bar member 106, or a combination thereof, can be included in a range of about 0.4 inches to about 1.4 inches. In an additional example, the inner diameter of the first bar member 102, the second bar member 104, the third bar member 106, or a combination thereof, can be included in a range of about 1.6 inches to about 2.6 inches.

The first connection member 108 and the second connection member 110 can be hollow having an outer diameter and an inner diameter that is less than the outer diameter. In some cases, the first connection member 108 and/or the second connection member 110 can have a relatively smooth inner diameter, while in other cases, the inner diameter of the first connection member 102 and/or the second connection member 104 can be at least partially threaded. In an embodiment, the outer diameter and/or the inner diameter of the first connection member 108 and/or the second connection member 110 can be approximately the same. In other instances, the outer diameter and/or the inner diameter of one or more of the first connection member 102 and/or the second connection member 104 can be different.

In various embodiments, the outer diameter of the first connection member 108 and/or the second connection member 110 can be at least about 0.3 inches, at least about 0.6 inches, or at least about 1 inch. Additionally, the outer diameter of the first connection member 108 and/or the second connection member 110 can be no greater than about 2.5 inches, no greater than about 2.1 inches, no greater than about 1.6 inches, or no greater than about 1.3 inches. In an illustrative example, the outer diameter of the first connection member 108 and/or the second connection member 104 can be included in a range of about 0.5 inches to about 1.5 inches. In an illustrative example, the outer diameter of the first connection member 108 and/or the second connection member 104 can be included in a range of about 1.2 inches to about 2.5 inches.

In some embodiments, the inner diameter of the first connection member 108 and/or the second connection member 110 can be at least about 0.2 inches, at least about 0.5 inches, or at least about 0.8 inches. Additionally, the inner diameter of the first connection member 108 and/or the second connection member 110 can be no greater than about 2.1 inches, no greater than about 1.7 inches, or no greater than about 1.2 inches. In an illustrative example, the inner diameter of the first connection member 108 and/or the second connection member 110 can be included in a range of about 0.3 inches to about 1.3 inches. In an illustrative example, the inner diameter of the first connection member 108 and/or the second connection member 110 can be included in a range of about 0.9 inches to about 2.1 inches.

In some embodiments, the first bar member 102, the second bar member 104, the third bar member 106, the first connection member 108, the second connection member 110, or a combination thereof, can include one or more of the same material. In other embodiments, the first bar member 102, the second bar member 104, the third bar member 106, the first connection member 108, the second connection member 110, or a combination thereof, can include one or more different materials. In an embodiment, first bar member 102, the second bar member 104, the third bar member 106, the first connection member 108, the second connection member 110, or a combination thereof, can include a metal. To illustrate, first bar member 102, the second bar member 104, the third bar member 106, the first connection member 108, the second connection member 110, or a combination thereof, can include a relatively lightweight metal, such as aluminum, alloys of aluminum, titanium, alloys of titanium, or a combination thereof. In another embodiment, first bar member 102, the second bar member 104, the third bar member 106, the first connection member 108, the second connection member 110, or a combination thereof, can include a polymer, such as a plastic. In an illustrative example, first bar member 102, the second bar member 104, the third bar member 106, the first connection member 108, the second connection member 110, or a combination thereof, can include polyvinyl chloride (PVC).

In an embodiment, the first bar member 102, the second bar member 104, the third bar member 106, the first connection member 108, the second connection member 110, or a combination thereof, can be formed from a single piece of material and be a continuous piece having the shape shown in the illustrative example of FIG. 1. In other embodiments, one or more of the first bar member 102, the second bar member 104, the third bar member 106, the first connection member 108, the second connection member 110, or a combination thereof, can be separate from the other components of the exercise device 100. In situations where one or more of the first bar member 102, the second bar member 104, the third bar member 106, the first connection member 108, the second connection member 110, or a combination thereof, are separate from other components of the exercise device 100, the separate components can be joined using a variety of techniques, such as welding techniques, chemical techniques using adhesive, and/or mechanical techniques using securing components (e.g., connectors, fasteners, pins, inserts, and the like).

In some embodiments, the first bar member 102, the second bar member 104, the third bar member 106, the first connection member 108, the second connection member 110, or a combination thereof, can be joined using one or more connectors. In an embodiment, at least one of the connectors can have a similar material to another one of the connectors. Additionally, at least one of the connectors can have a different material from another one of the connectors. In an illustrative example, one or more of the connectors can include a plastic. To illustrate, at least one of the connectors can include a high molecular weight plastic. Further, one or more of the connectors can include a metal. In an example, one or more of the connectors can include aluminum or alloys of aluminum.

In an embodiment, the first bar member 102 can be joined to the first connection member 108 using a tee connector. Additionally, the second bar member 104 can be joined to the first connection member 108 using an additional tee connector. In particular embodiments, the first connection member 108 can be joined to the second connection member 110 using a connector, such as an L-shaped connector or a tee connector. Further, the second connection member 110 can be joined to the third bar member 106 using another tee connector. In various embodiments, the first bar member 102, the second bar member 104, the third bar member 106, the first connection member 108, the second connection member 110, or a combination thereof, can be joined to the connectors via one or more mechanical means, such as screws, bolts, pins, or a combination thereof. Alternatively, or additionally, the first bar member 102, the second bar member 104, the third bar member 106, the first connection member 108, the second connection member 110, or a combination thereof, can be joined to the connectors using chemical means, such as an adhesive. In still other situations, the first bar member 102, the second bar member 104, the third bar member 106, the first connection member 108, the second connection member 110, or a combination thereof, can be joined to connectors using a process such as welding. The first bar member 102, the second bar member 104, the third bar member 106, the first connection member 108, the second connection member 110, or a combination thereof, can also be joined, in some cases, using one or more additional securing components, such as one or more inserts and/or one or more fasteners.

In some cases, the pads 112, 114, 116, 118, 120, 122 can have an outer diameter and/or an inner diameter that is substantially the same. In other situations, at least one of the pads 112, 114, 116, 118, 120, 122 can have a different diameter than at least another one of the pads 112, 114, 116, 118, 120, 122. In an example, the pads 112, 114, 116, 118 can have substantially the same outer diameter and inner diameter and the pads 120 can have substantially the same outer diameter and inner diameter that are different from the outer diameter and inner diameter of the pads 112, 114, 116, 118.

In various embodiments, the outer diameter of one or more of the pads 112, 114, 116, 118, 120, 122, can be at least about 0.6 inches, at least about 1.1 inches, at least about 1.6 inches, or at least about 2.1 inches. Additionally, the outer diameter of one or more of the pads 112, 114, 116, 118, 120, 122, can be no greater than about 4 inches, no greater than about 3.6 inches, no greater than about 3.1 inches, or no greater than about 2.6 inches. In an illustrative example, the outer diameter of one or more of the pads 112, 114, 116, 118, 120, 122 can be included in a range of about 0.5 inches to about 4.5 inches. In another illustrative example, the outer diameter of one or more of the pads 112, 114, 116, 118, 120, 122 can be included in a range of about 0.6 inches to about 1.2 inches. In an additional illustrative example, the outer diameter of one or more of the pads 112, 114, 116, 118, 120, 122, can be included in a range of about 2.5 inches to about 3.5 inches.

In various embodiments, the inner diameter of one or more of the pads 112, 114, 116, 118, 120, 122, can be at least about 0.4 inches, at least about 0.7 inches, at least about 1 inch, or at least about 1.4 inches. Additionally, the inner diameter of one or more of the pads 112, 114, 116, 118, 120, 122, can be no greater than about 3 inches, no greater than about 2.6 inches, no greater than about 2.1 inches, no greater than about 1.6 inches, or no greater than about 1.1 inches. In an illustrative example, the inner diameter of one or more of the pads 112, 114, 116, 118, 120, 122, can be included in a range of about 0.3 inches to about 3.5 inches. In another illustrative example, the inner diameter of one or more of the pads 112, 114, 116, 118, 120, 122, can be included in a range of about 0.5 inches to about 1.5 inches. In an additional illustrative example, the inner diameter of one or more of the pads 112, 114, 116, 118, 120, 122 can be included in a range of about 1.5 inches to about 2.5 inches.

In some cases, the first connection member 108, the second connection member 110, or both can be extendable. For example, the first connection member 108, the second connection member 110, or both can include an outer portion an inner portion that is movable within the outer portion. In an illustrative scenario, the inner portion of the first connection member 108 can move along an axis on which the outer portion of the first connection member 108 is arranged to adjust a height of the first connection member 108. In another illustrative scenario, the inner portion of the second connection member 110 can move along an axis on which the outer member of the second connection member 110 is arranged to adjust a length of the second connection member 110. In a particular embodiment, the outer portion of the first connection member 108 and/or the outer portion of the second connection member 110 can include a number of holes, such as holes 124 of the second connection member 110. In some cases, the inner portion of the first connection member 108 and/or the inner portion of the second connection member 110 can include a pin or push button that fits within the holes. In this way, a pin or push button can be depressed to release the inner portion of the first connection member 108 or the inner portion of the second connection member 110 and the inner portion can then be slidably moved along the outer portion to a new position that adjusts the size of the first connection member 108 or the second connection member 110.

In the illustrative example of FIG. 1, the first bar member 102 is disposed along a first horizontal axis 126. Additionally, the first connection member is disposed along a vertical axis 128 and the second bar member 104 is disposed along a second horizontal axis 130. The vertical axis 128 can be substantially perpendicular to the first horizontal axis 126 and the second horizontal axis 130. Further, the second horizontal axis can be substantially parallel to the first horizontal axis. The second connection member 110 can be disposed along a third horizontal axis that is substantially perpendicular to the vertical axis 128, substantially perpendicular to the first horizontal axis 126, and substantially perpendicular to the second horizontal axis 128. Also, the third bar member 134 is disposed along a fourth horizontal axis that is substantially perpendicular to the third horizontal axis 132, substantially parallel to the first horizontal axis 126, and substantially parallel to the second horizontal axis 130.

Figure 2:
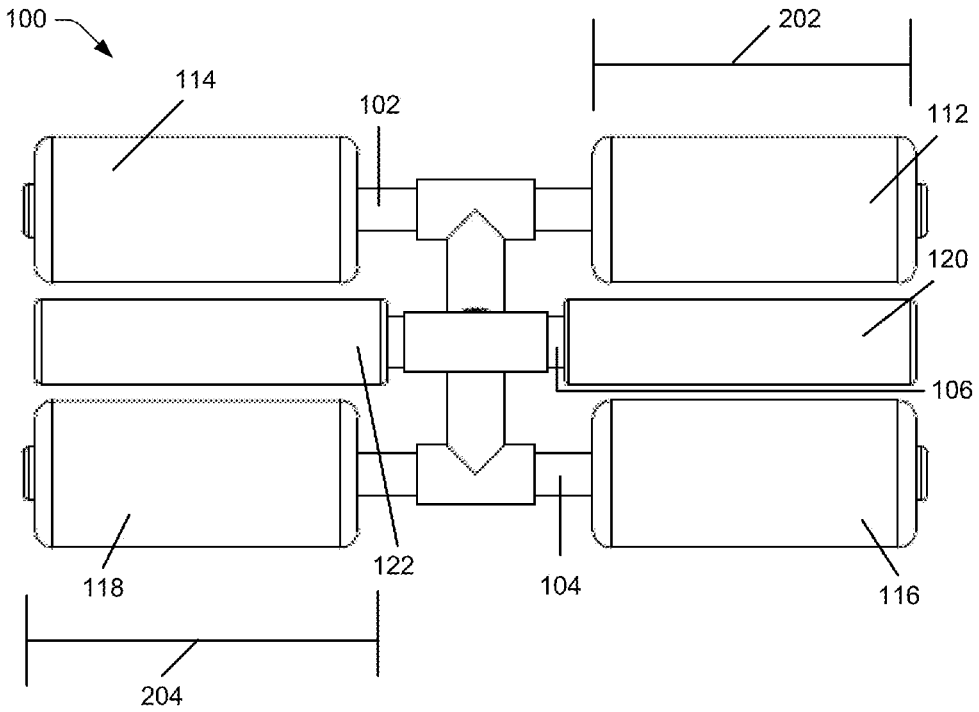
FIG. 2 is a rear view of an embodiment of an exercise device.

FIG. 2 is a rear view of an embodiment of the exercise device 100. The exercise device 100 can include the first bar member 102, the second bar member 104, and the third bar member 106. The exercise device 100 can also include the pads 112, 114, 116, 118, 120, and 122. The illustrative example of FIG. 2 includes a first width 202 of the pad 112 and a second width of the pad 118. In some cases, the first width 202 and the second width 204 can be substantially the same, while in other situations, the first width 202 and the second width 204 can be different. In an embodiment, the first width 202 and/or the second width 204 can be at least about 3 inches, at least about 3.5 inches, at least about 4 inches, at least about 4.5 inches, or at least about 5 inches. In other embodiments, the first width 202 and/or the second width 204 can be no greater than about 8 inches, no greater than about 7.5 inches, no greater than about 7 inches, no greater than about 6.5 inches, or no greater than about 6 inches. In an illustrative example, the first width 202 and/or the second width 204 can be included in a range of about 4 inches to about 7 inches.

Figure 3:
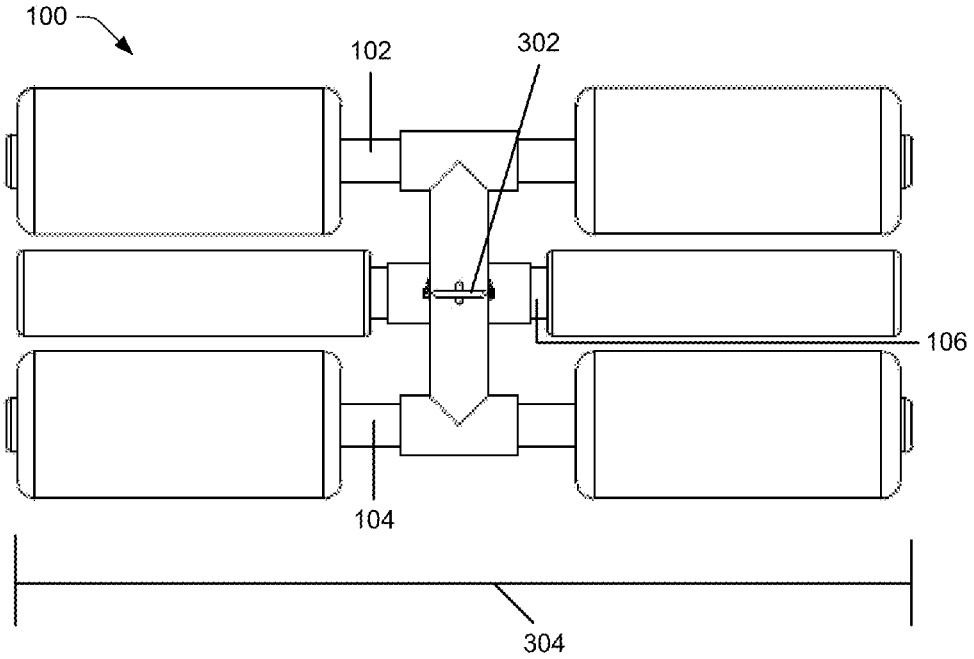
FIG. 3 is a right side view of an embodiment of an exercise device.

FIG. 3 is a right side view of an embodiment of the exercise device 100. The exercise device 100 can include the first bar member 102, the second bar member 104, and the third bar member 106. The exercise device 100 can also include an anchor 302. The anchor 302 can be used to couple the exercise device 100 to an exercise apparatus (not shown). In some cases, the exercise apparatus can include weights, such as a weight rack of a pull-down exercise machine. The anchor 302 can also be used to couple the exercise device 100 to resistance bands.

In addition, the first bar member 102, the second bar member 104, the third bar member 106, or a combination thereof, can have a respective width 304. In an embodiment, at least two of the first bar member 102, the second bar member 104, and the third bar member 106 can have substantially the same width, while in other situations, at least two of the first bar member 102, the second bar member 104, and the third bar member 106 can have a different width. In some instances, the width 304 can be at least about 7 inches, at least about 7.5 inches, at least about 8 inches, at least about 8.5 inches, at least about 9 inches, at least about 9.5 inches, at least about 10 inches, at least about 10.5 inches, or at least about 11 inches. Further, the width 304 can be no greater than about 20 inches, no greater than about 18 inches, no greater than about 17.5 inches, no greater than about 16.5 inches, no greater than about 15.5 inches, no greater than about 14.5 inches, no greater than about 14 inches, no greater than about 13 inches, no greater than about 12.5 inches, or no greater than about 12 inches. In an illustrative example, the width 304 can be included in a range of about 6 inches to about 25 inches. In another illustrative example, the width 304 can be included in a range of about 7 inches to about 16 inches. In an additional illustrative example, the width 304 can be included in a range of about 10 inches to about 20 inches. In a further illustrative example, the width 304 can be included in a range of about 9 inches to about 18 inches. In some cases, the width of the first bar member 102, the width of the second bar member 104, and/or the width of the third bar member 106 can be adjustable.

Figure 4:
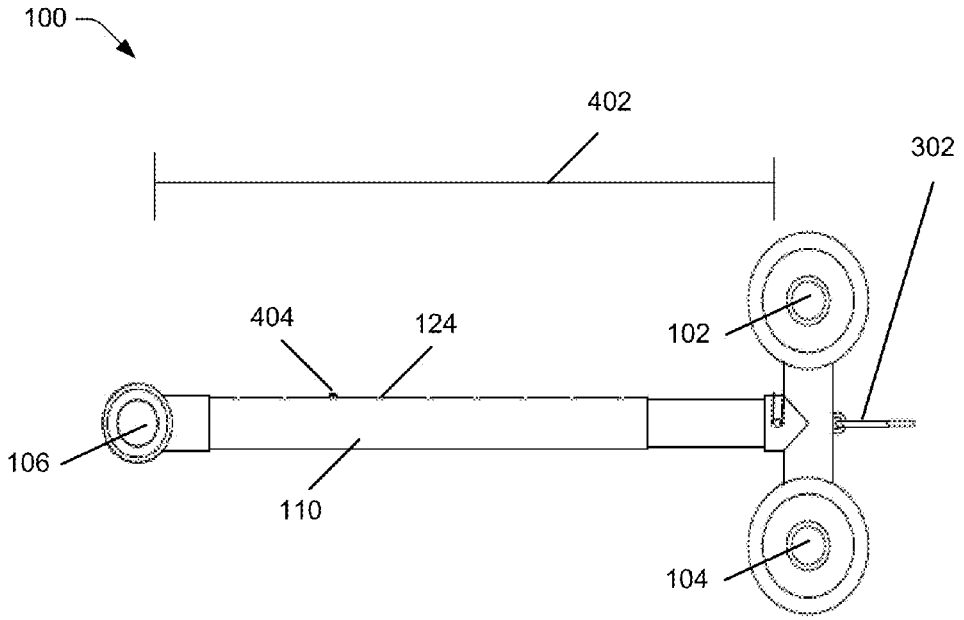
FIG. 4 is a left side view of an embodiment of an exercise device.

FIG. 4 is a left side view of an embodiment of the exercise device 100. The exercise device 100 can include the first bar member 102, the second bar member 104, the third bar member 106, and the second connection member 110. The exercise device 100 can also include an anchor 302. The second connection member 110 can include a number of holes 124.

The second connection member 110 can have a length 402. In some cases, the length 402 can be adjustable. For example, an inner portion of the second connection member 110 can include a push pin or push button 404 that can fit within one of the holes 124 to set the length 402. In an embodiment, the length 402 can be at least about 10 inches, at least about 11 inches, at least about 12 inches, at least about 13 inches, at least about 13.5 inches, or at least about 14 inches. In another embodiment, the length 402 can be no greater than about 24 inches, no greater than about 20 inches, no greater than about 19 inches, no greater than about 18 inches, no greater than about 17.5 inches, no greater than about 17 inches, no greater than about 16.5 inches, no greater than about 16 inches, no greater than about 15.5 inches, or no greater than about 15 inches. In an illustrative example, the length 402 can be included in a range of about 6 inches to about 36 inches. In another illustrative example, the length 402 can be included in a range of about 13 inches to about 20 inches.

In various embodiments, the outer portion of the second connection member 110 can be relatively hollow with an inner portion of the second connection member 110 disposed within a bore of the outer portion. The inner portion can be comprised of a rod that can be solid or hollow. The inner portion can have a length that is different from that of the outer portion. In some situations, the inner portion can have a length included in a range of about 7 inches to about 20 inches, while in other instances, the inner portion can have a length included in a range of about 10 inches to about 18 inches. In an illustrative example, the outer portion can have a length included in a range of about 6 inches to about 18 inches. In another illustrative example, the outer portion can have a length included in a range of about 8 inches to about 15 inches.

Figure 5:
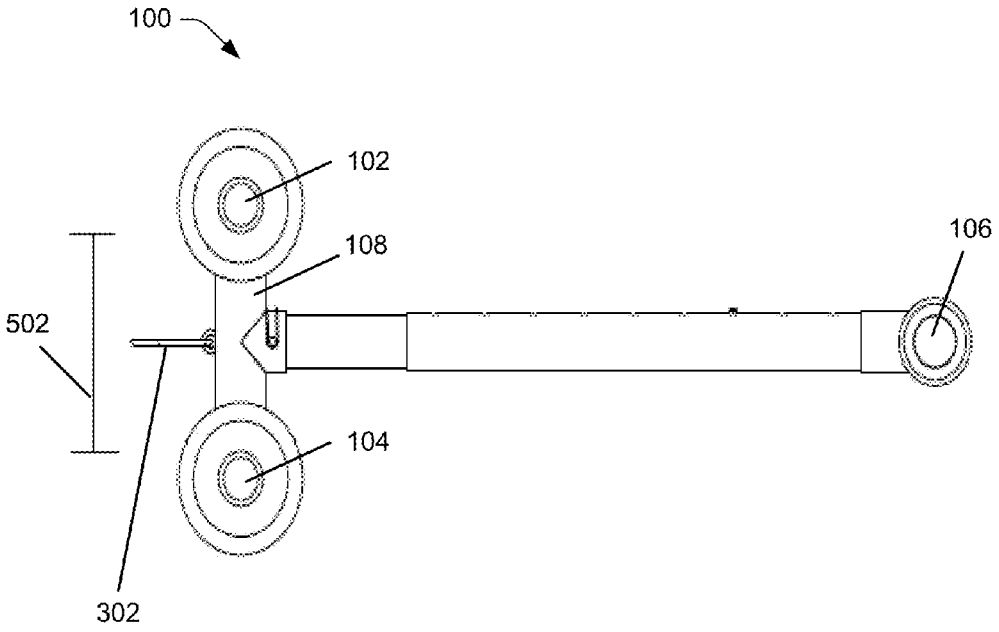
FIG. 5 is a front view of an embodiment of an exercise device.

FIG. 5 is a front view of an embodiment of the exercise device 100. The exercise device 100 can include the first bar member 102, the second bar member 104, the third bar member 106, and the first connection member 108. The exercise device 100 can also include an anchor 302. The first connection member 108 can have a height 502. In some cases, the height 502 can be adjustable.

In an embodiment, the height 502 can be at least about 1.5 inches, at least about 2 inches, at least about 2.5 inches, at least about 3 inches, or at least about 3.5 inches. In another embodiment, the height 502 can be no greater than about 7 inches, no greater than about 6.5 inches, no greater than about 6 inches, no greater than about 5.5 inches, no greater than about 5 inches, no greater than about 4.5 inches, or no greater than about 4 inches. In an illustrative example, the height 502 can be included in a range of about 2 inches to about 10 inches. In another illustrative example, the height 502 can be included in a range of about 3 inches to about 6 inches.

Figure 6:
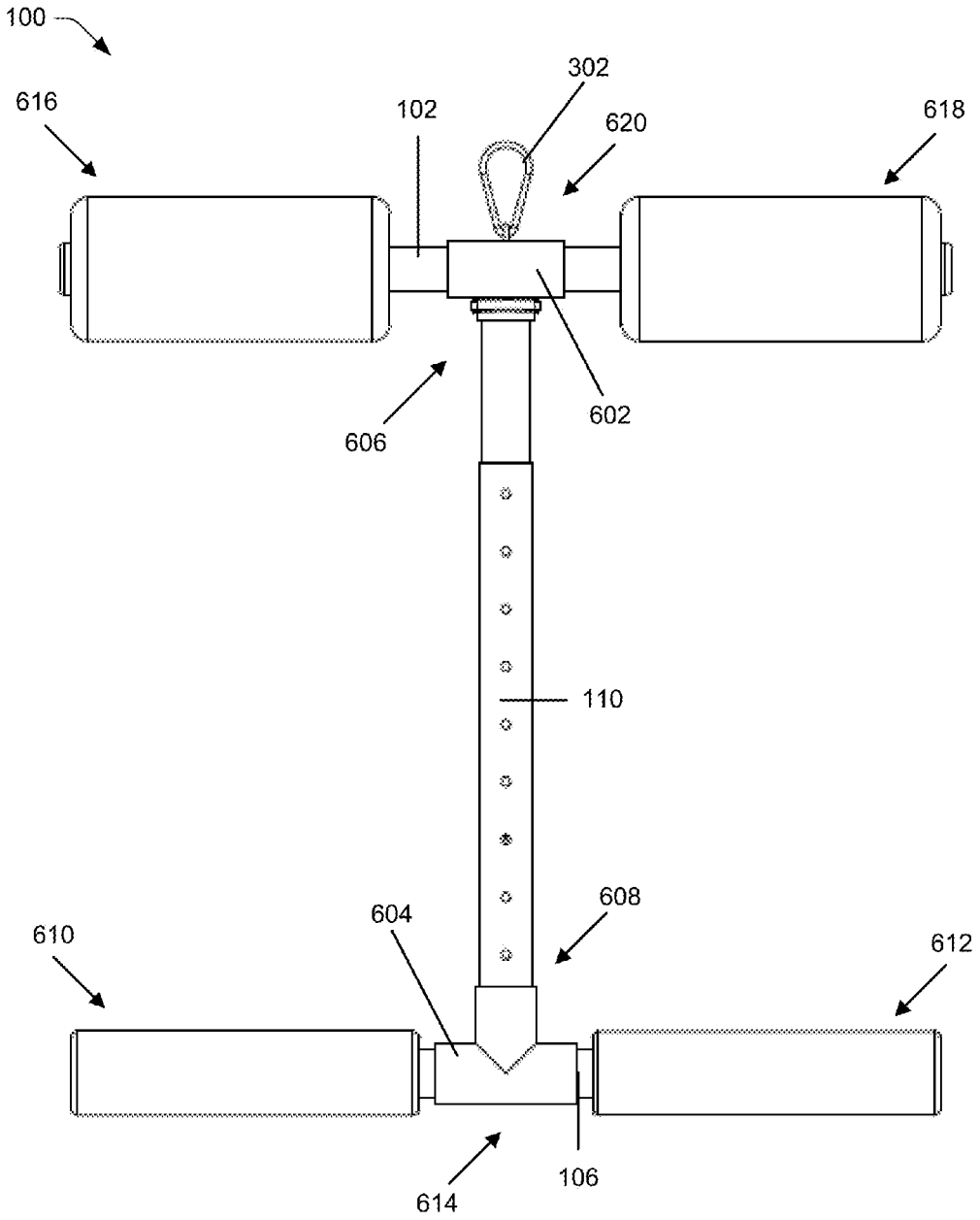
FIG. 6 is a top view of an embodiment of an exercise device.

FIG. 6 is a top view of an embodiment of the exercise device 100. The exercise device 100 can include the first bar member 102, the third bar member 106, and the second connection member 110. The exercise device 100 can also include an anchor 302. Furthermore, the exercise device 100 can include a first securing component 602 and a second securing component 604. The first securing component 602 can couple the first bar member 102 with the first connection member 108 (not shown) and the second securing component 604 can couple the third bar member 106 to the second connection member 110. In some cases, the first securing component 602 and/or the second securing component 604 can include a tee connector. The second connection member 110 can include a first end portion 606 where the second connection member 110 can be coupled to the first connection member 108 (not shown). In addition, the second connection member 110 can include a second end portion 608 where the second connection member 110 can be coupled to the third bar member 106 using the second securing component 604.

Additionally, the third bar member 106 can include a first end portion 610 and a second end portion 612. The first end portion 610 and the second end portion 612 can be located at opposite ends of the third bar member 102. In some cases, a respective pad can occupy at least a portion of the first end portion 610 and the second end portion 612. The third bar member 102 can also include a middle portion 614 disposed between the first end portion 610 and the second end portion 612. The third bar member 106 can be coupled to the second connection member 110 in the middle portion 614 using the second securing component 604.

The first bar member 102 also includes a first end portion 616 and a second end portion 618. The first end portion 616 and the second end portion 618 can be located at opposite ends of the first bar member 102. In some cases, a respective pad can occupy at least a portion of the first end portion 616 and the second end portion 618. The first bar member 102 can also include a middle portion 620 disposed between the first end portion 616 and the second end portion 618. The first bar member 102 can be coupled to the first connection member 108 (not shown) in the middle portion 620 using the first securing component 602.

Figure 7:
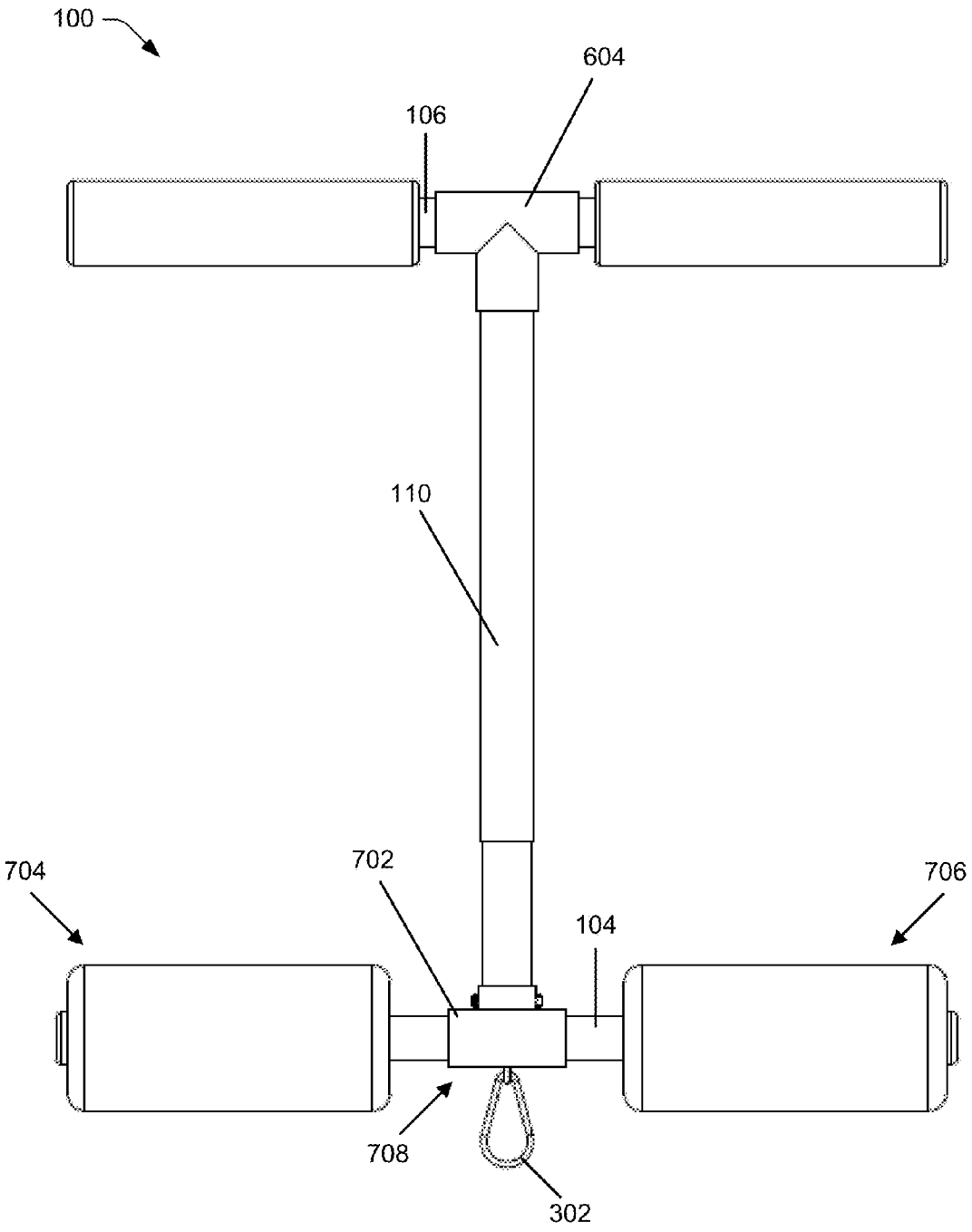
FIG. 7 is a bottom view of an embodiment of an exercise device.

FIG. 7 is a bottom view of an embodiment of the exercise device 100. The exercise device 100 can include the second bar member 104, the third bar member 106, and the second connection member 110. The exercise device 100 can also include an anchor 302. Additionally, the exercise device 100 can include the second securing component 604 and a third securing component 702. The third securing component 702 can couple the second bar member 104 to the first connection member 108 (not shown).

The second bar member 104 can include a first end portion 704 and a second end portion 706. The first end portion 704 and the second end portion 706 can be located at opposite ends of the second bar member 104. In some cases, a respective pad can occupy at least a portion of the first end portion 704 and the second end portion 706. The second bar member 104 can also include a middle portion 708 disposed between the first end portion 704 and the second end portion 706. The second bar member 104 can be coupled to the second connection member 110 in the middle portion 708 using the third securing component 702.

Figure 8:
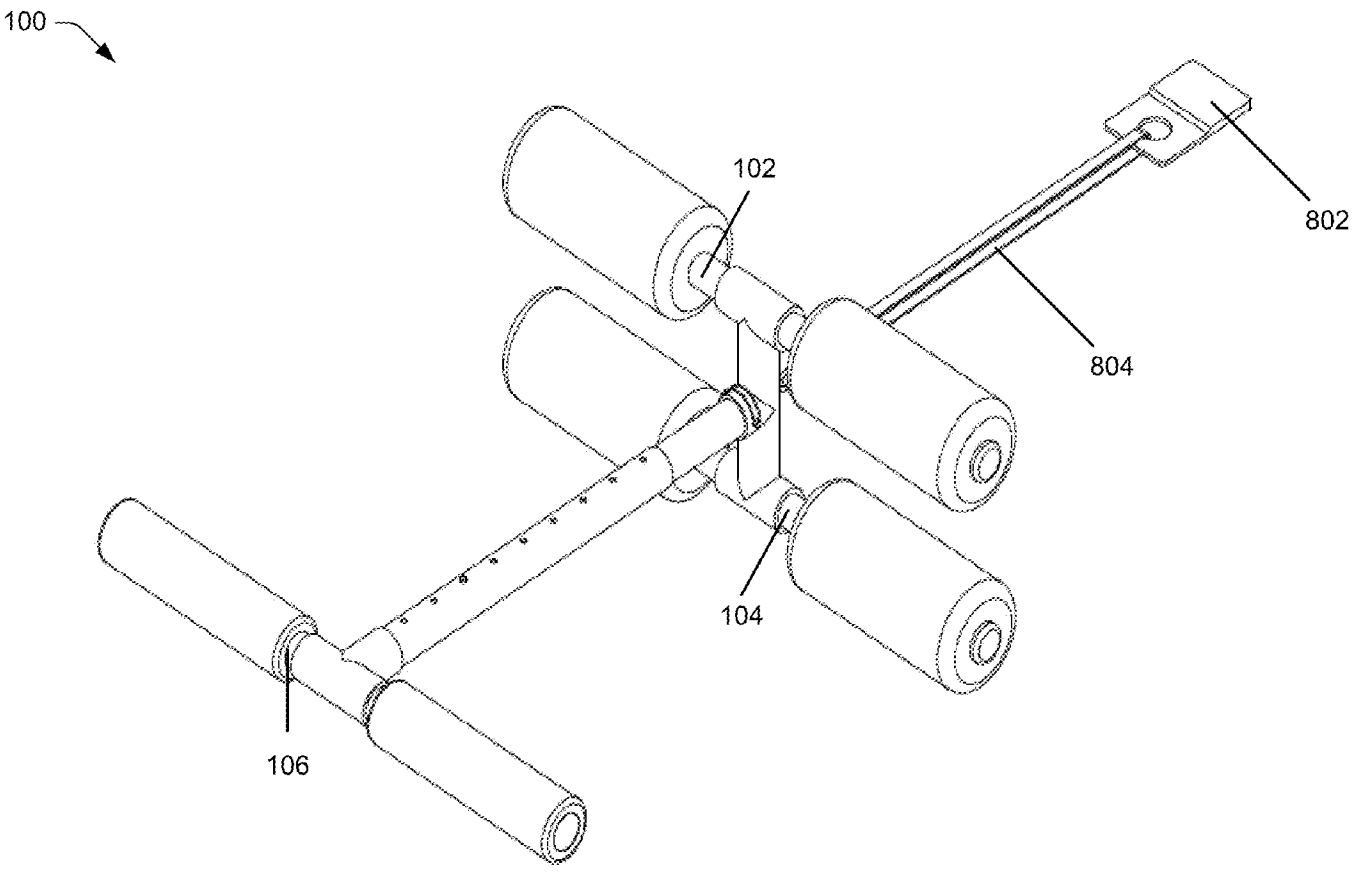
FIG. 8 is a perspective view of an embodiment of an exercise device having an anchor member.

FIG. 8 is a perspective view of an embodiment of the exercise device 100 having an anchor. The exercise device 100 can include the first bar member 102, the second bar member 104, and the third bar member 106. The exercise device 100 can also include the anchor 302 (not shown). The anchor 302 can be used to couple the exercise device 100 to a mount 802. In some cases, the mount 802 can be a part of an exercise apparatus. In other situations, the mount 802 can be coupled to another structure, such as a piece of furniture or a door frame. In an embodiment, the exercise device 100 can be attached to the mount 802 via a fastening line 804. The fastening line 804 can be made of a flexible and stretchy material that allows for movement of the exercise device with respect to the mount 802. In an illustrative example, the fastening line 804 can include one or more resistance bands.

Figure 9:
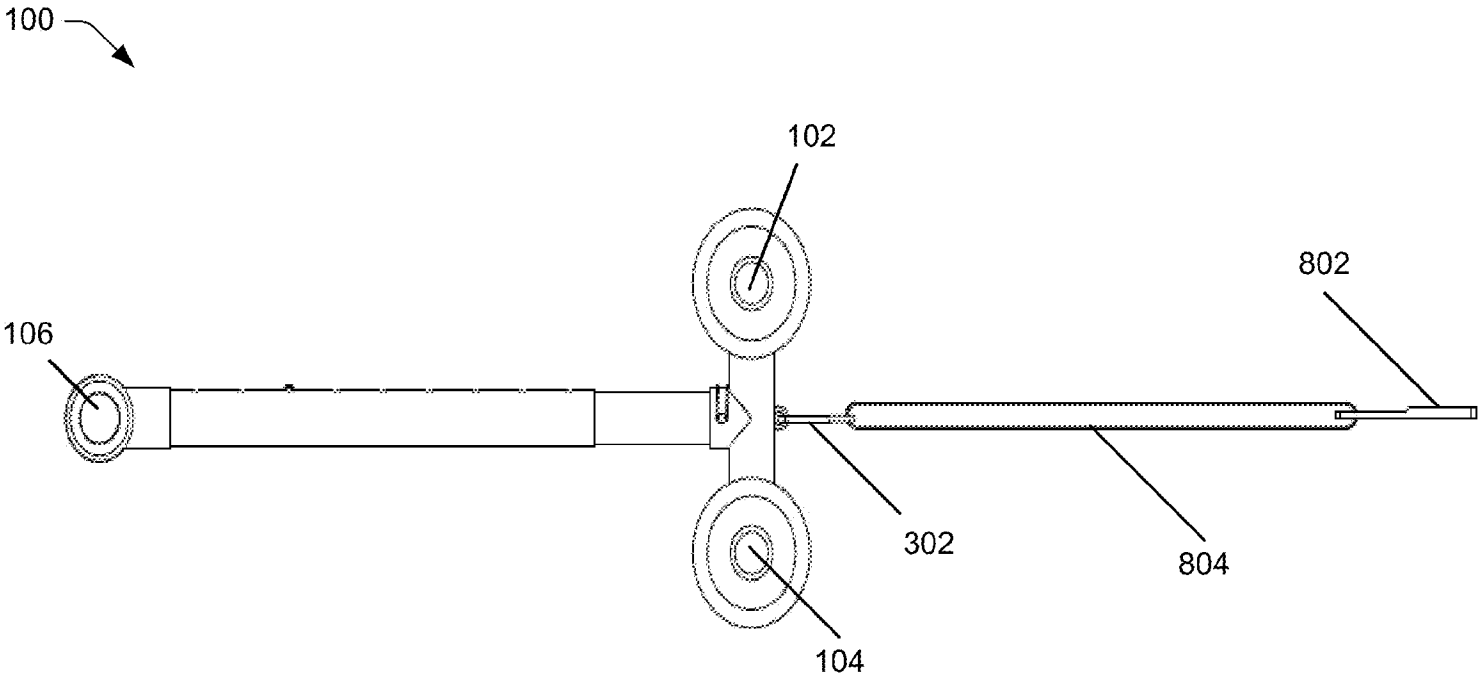
FIG. 9 is a right side view of an embodiment of an exercise device having an anchor member.

FIG. 9 is a right side view of an embodiment of the exercise device 100 having the anchor 302. The exercise device 100 can include the first bar member 102, the second bar member 104, and the third bar member 106. The anchor 302 can be used to couple the exercise device 100 to the mount 802. The exercise device 100 can be attached to the mount 802 via the fastening line 804.

Figure 10:
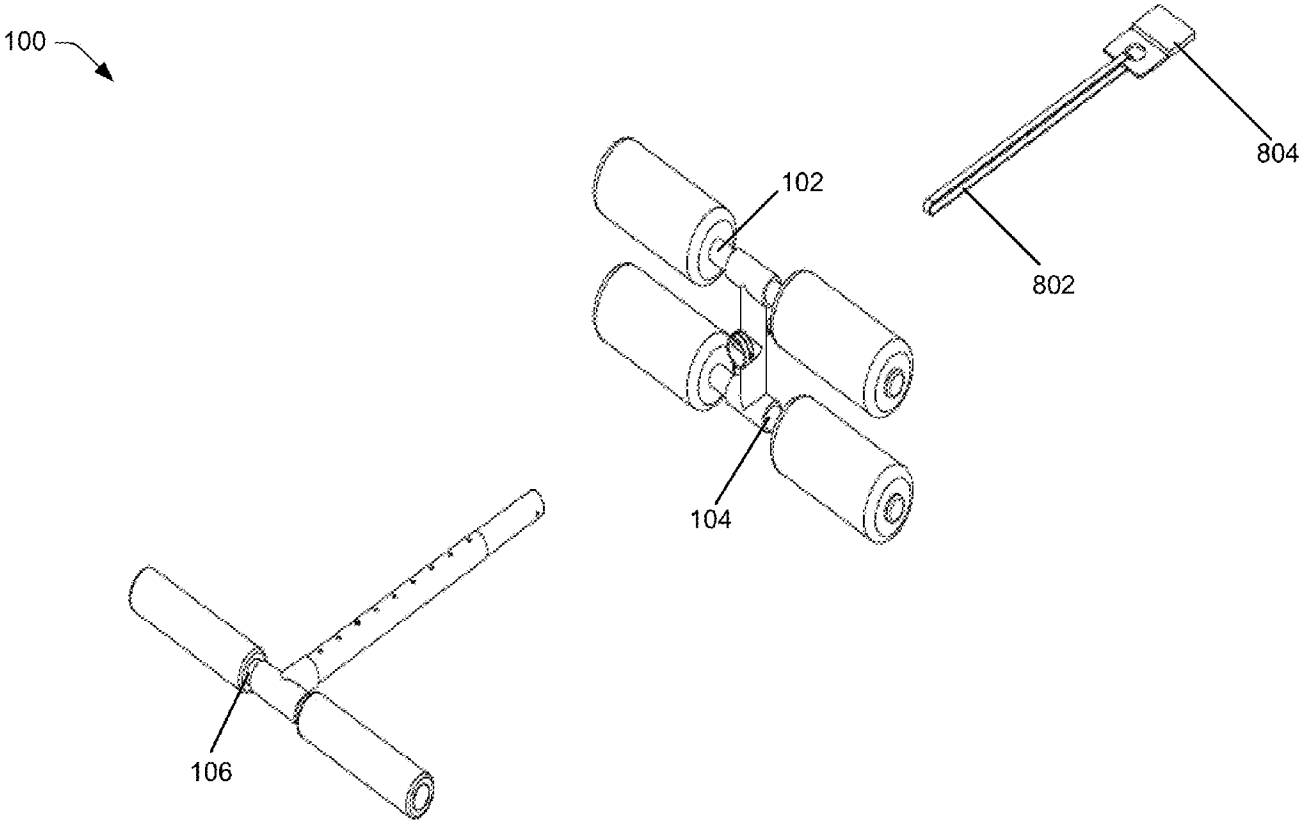
FIG. 10 is an exploded perspective view of an embodiment of an exercise device having an anchor member.

FIG. 10 is an exploded perspective view of an embodiment of the exercise 100 having an anchor. The exercise device 100 can include the first bar member 102, the second bar member 104, and the third bar member 106. The exercise device 100 can also include the anchor 302 (not shown). The anchor 302 can be used to couple the exercise device 100 to the mount 802. The exercise device 100 can be attached to the mount 802 via the fastening line 804.

Figure 11:
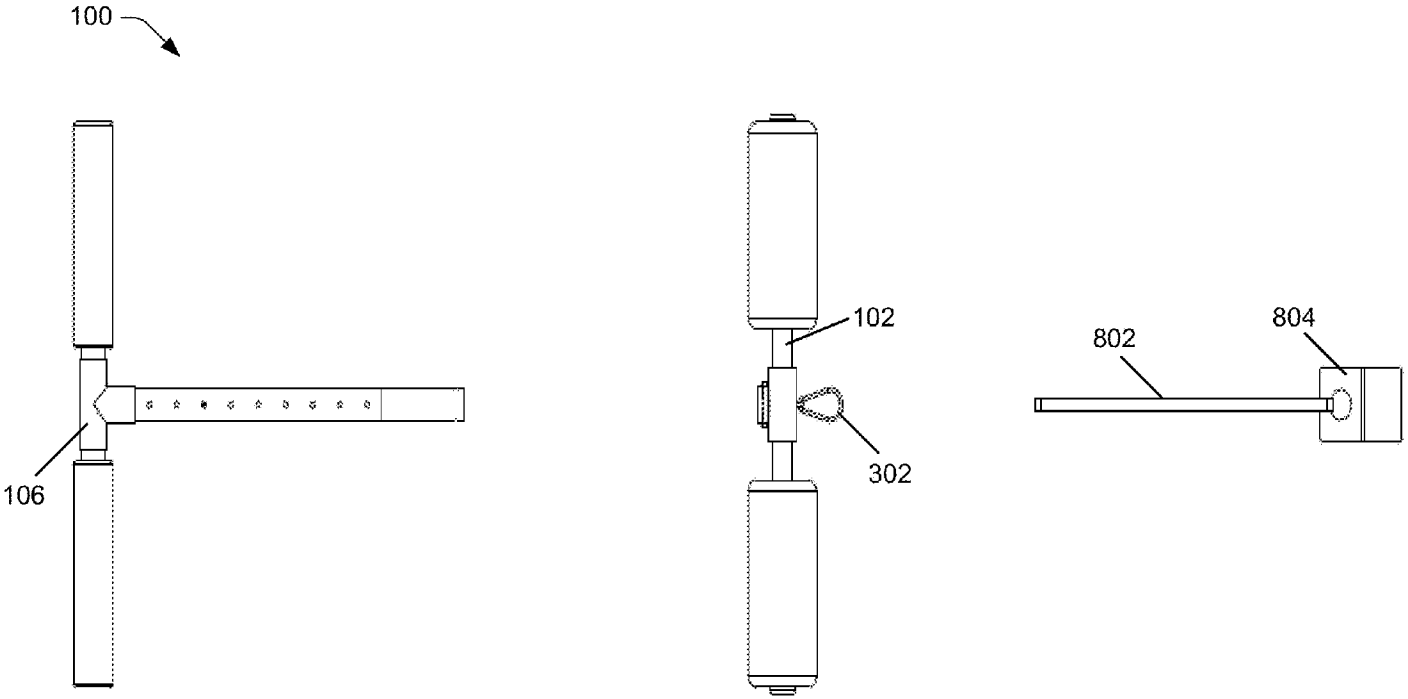
FIG. 11 is a top view of an embodiment of an exercise device having an anchor member.

FIG. 11 is a top view of an embodiment of the exercise device 100 having the anchor 302. The exercise device 100 can include the first bar member 102 and the third bar member 106. The anchor 302 can be used to couple the exercise device 100 to the mount 802. The exercise device 100 can be attached to the mount 802 via the fastening line 804.

Figure 12:
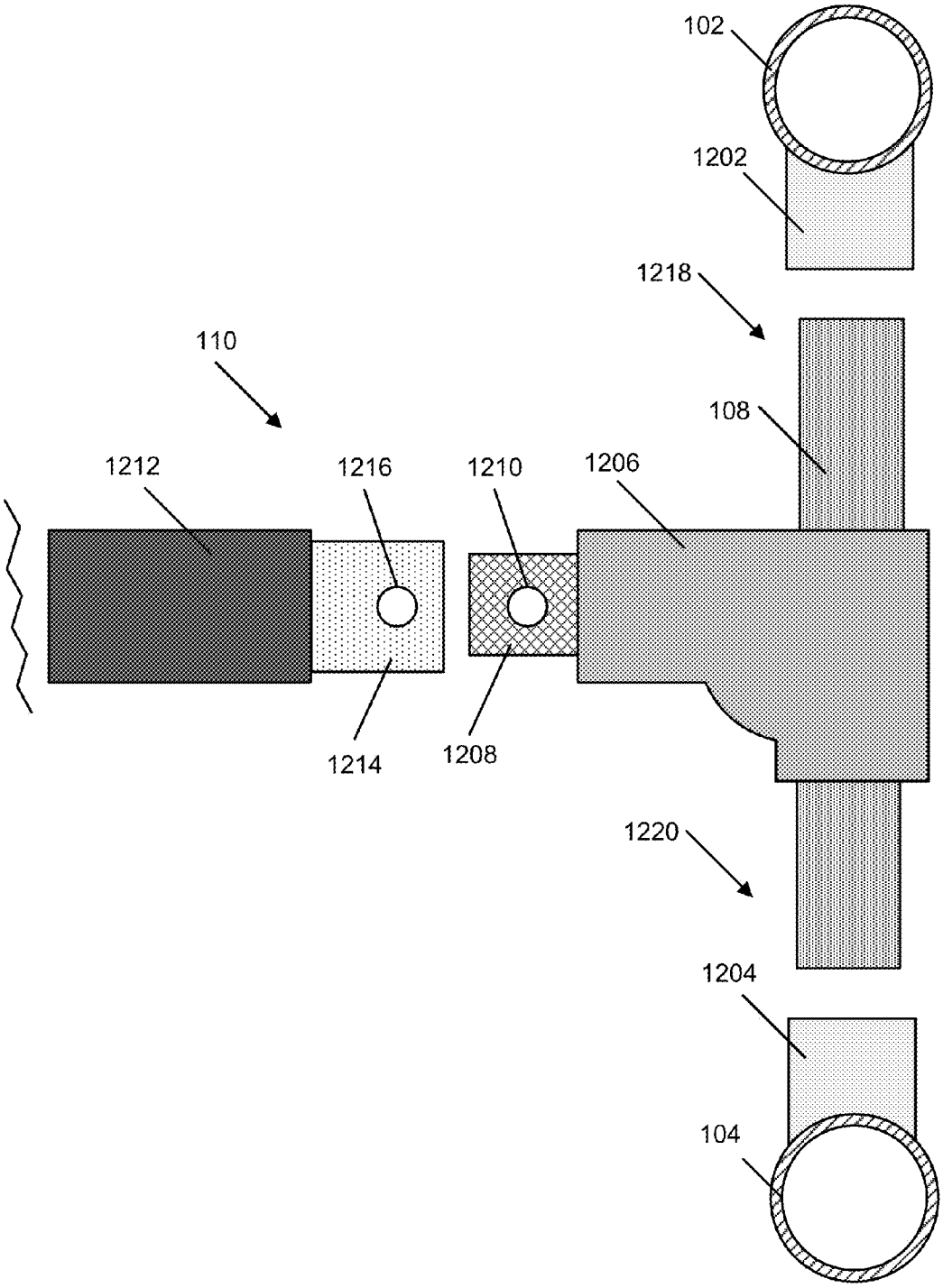
FIG. 12 is a view of an embodiment of an exercise device having one or more connection units.

FIG. 12 is a view of an embodiment of an exercise device having one or more connection members. In some cases, the connection members can have a single component. In other cases, at least one of the connection members can have multiple components. Additionally, the connection members can be joined using one or more securing components.

In the illustrative example of FIG. 12, the first connection member 108 can be joined to the first bar member 102 using a first securing component 1202. In some cases, the first securing component 1202 can include a tee connector. Additionally, the first securing component 1202 can have an inner diameter that is greater than an outer diameter of the first connection member 108. For example, the first securing component 1202 can have an inner diameter included in a range of about 0.5 inches to about 2.5 inches. In another example, the first securing component 1202 can have an inner diameter included in a range of about 0.7 inches to about 1.5 inches.

Further, the first connection member 108 can be coupled to the second bar member 104 using a second securing component 1204. In an embodiment, the second securing component 1204 can include a tee connector. The second securing component 1204 can have an inner diameter that is greater than an outer diameter of the second bar member 104. In an illustrative example, the second securing component 1204 can have an inner diameter included in a range of about 0.5 inches to about 2.5 inches. In another illustrative example, the second securing component 1204 can have an inner diameter included in a range of about 0.7 inches to about 1.5 inches.

In an embodiment, the second connection member 110 can be coupled with the first connection member 108 using a third securing component 1206. The third securing component 1206 can be a tee connector, in some scenarios. In some situations, the third securing component 1206 can be located at approximately a midpoint between ends of the first connection member 108. In other cases, the third securing component 1206 can be disposed more toward the first bar member 102 or more toward the second bar member 102 along the first connection member 108.

In various scenarios, the first securing component 1202 can be coupled to the first bar member 102 via one or more bolts, screws, pins, washers, combinations thereof, and the like. Additionally, the second securing component 1204 can be coupled to the second bar member 104 via one or more bolts, screws, pins, washers, combinations thereof, and the like. Further, the third securing component 1206 can be coupled to the first connection member 108 and/or the second connection member 110 via one or more bolts, screws, pins, washers, combinations thereof, and the like. In some instances, the first securing component 1202 can be coupled to the first bar member 102 via an adhesive, the second securing component 1204 can be coupled to the second bar member 104 via an adhesive, the third securing component 1206 can be coupled to the first connection member 108 via an adhesive, the third securing component 1206 can be coupled to the second connection member 108 via an adhesive, or a combination thereof.

The first securing component 1202, the second securing component 1204, the third securing component 1206, or a combination thereof, can include materials similar to those of the first bar member 102, the second bar member 104, the first connection member 108, the second connection member 110, or a combination thereof. In addition, the first securing component 1202, the second securing component 1204, the third securing component 1206, or a combination thereof, can include materials different from those of the first bar member 102, the second bar member 104, the first connection member 108, the second connection member 110, or a combination thereof. Also, at least two of the first securing component 1202, the second securing component 1204, the third securing component 1206, or a combination thereof, can include similar materials, while in other situations, at least two of the first securing component 1202, the second securing component 1204, the third securing component 1206, or a combination thereof, can include different materials. For example, the first securing component 1202, the second securing component 1204, the third securing component 1206, or a combination thereof, can include a metal. In an illustrative example, the first securing component 1202, the second securing component 1204, the third securing component 1206, or a combination thereof, can include aluminum, alloys of aluminum, titanium, alloys of titanium, or a combination thereof. In another example, the first securing component 1202, the second securing component 1204, the third securing component 1206, or a combination thereof, can include a plastic. In an additional illustrative example, the first securing component 1202, the second securing component 1204, the third securing component 1206, or a combination thereof, can include polyvinyl chloride (PVC).

In the illustrative example of FIG. 12, an adapter member 1208 can be used to couple the third securing component 1206 to the second connection member 110. The adapter member 1208 can include a material, such as a plastic or a metal, and be coupled to the third securing component 1206 using an adhesive, one or more screws, one or more bolts, one or more washers, one or more pins or a combination thereof. Additionally, the adapter member 1208 can include a hole 1210.

The second connection member 110 can include an outer component 1212 and an inner component 1214. The inner component 1214 can have an outer diameter that is less than an inner diameter of the outer component 1212. In an illustrative example, the inner component 1214 can have an outer diameter included in a range of about 0.3 inches to about 2.1 inches. In another illustrative example, the inner component 1214 can have an outer diameter included in a range of about 0.6 inches to about 1.8 inches. Additionally, a length of the outer component 1212 can be included in a range of about 5 inches to about 15 inches and a length of the inner component 1214 can be included in a range of about 7 inches to about 18 inches.tre In some cases, the inner component 1214 can include a hole 1216 that can be used to couple the inner component 1214 to the adapter member 1208 via the hole 1210. In a particular embodiment, the hole 1216 and the hole 1210 can be aligned and a pin can be inserted therein. The inner component 1214 can move along the length of the outer component 1212. In some cases, the inner component 1214 can include a push button or pin that can engage with a hole in the outer component 1212. In this way, the length of the second connection member 110 can be increased or decreased in order to be used by individuals having a variety of body dimensions, such as varying heights, varying torso lengths, varying leg lengths, combinations thereof, and so forth. The length of the second connection member 110 can also be modified to work different muscles in the body of an individual, such as different abdominal muscles.

The first connection member 108 can also include a first end portion 1218 and a second end portion 1220. The first end portion 1218 and the second end portion 1220 can be located at opposite ends of the first connection member 108. In some cases, the first connection member 108 can be coupled to the first bar member 102 at the first end portion 1218 using the first securing component 1202. Additionally, the first connection member 108 can be coupled to the second bar member 104 at the second end portion 1220 using the second securing component 1204.

Figure 13:
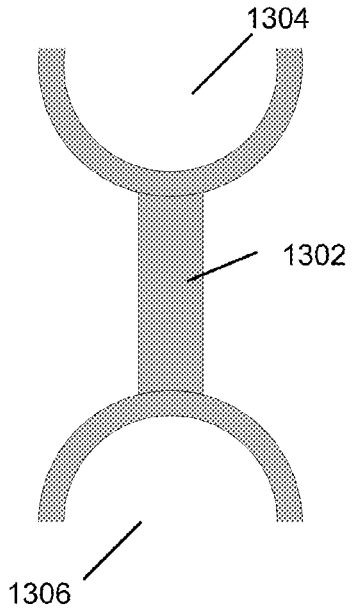
FIG. 13 is a side view of an embodiment of an attachment member for adding weight to an exercise device.

FIG. 13 is a side view of an embodiment of an attachment member 1302 for adding weight to an exercise device, such as the exercise device 100 of FIG. 1. The attachment member 1302 can include be shaped to include a first opening 1304 and a second opening 1306. The first opening 1304 and the second opening 1306 can be disposed at opposite ends of the attachment member 1302. In an embodiment, the first opening 1304 can be used to hold weights, such as hand weights. In a particular embodiment, a barrel or hand-held area of the weights can be inserted into the first opening 1304 and be coupled to the attachment member 1302. In some cases, the weights can snap into place within the first opening 1304. In other cases, the weights can be coupled to the attachment member 1302 using a coupling device, such as a screw or pin. In some scenarios, the inner diameter of the first opening 1304 can be substantially the same as a diameter of a region of the weights that can be inserted into the first opening 1304. In other situations, the inner diameter of the first opening 1304 can be greater that the diameter of the region of the weights that can be inserted into the first opening 1304. In an illustrative embodiment, the first opening 1304 can have an inner diameter included in a range of about 0.4 inches to about 2.5 inches. In an additional illustrative embodiment, the first opening 1304 can have an inner diameter included in a range of about 0.5 inches to 1.5 inches.

The second opening 1306 can be used to couple the attachment member 1302 to the exercise device 100. For example, the second opening 1306 can have an inner diameter that is larger than an outer diameter of a portion of the first bar member 102 of FIG. 1, an outer diameter of a portion of the first connection member 108 of FIG. 1, an outer diameter of a portion of the second connection member 110 of FIG. 1, or a combination thereof. In an illustrative embodiment, the second opening 1306 can have an inner diameter included in a range of about 0.4 inches to about 2.5 inches. In an additional illustrative embodiment, the second opening 1306 can have an inner diameter included in a range of about 0.5 inches to 1.5 inches. In this way, the attachment member 1302 can be coupled to the exercise device 100. In some instances, the attachment member 1302 can be removably coupled to the exercise device 100 using one or more securing components, such as one or more screws, one or more pins, one or more bolts, or a combination thereof.

Figure 14:
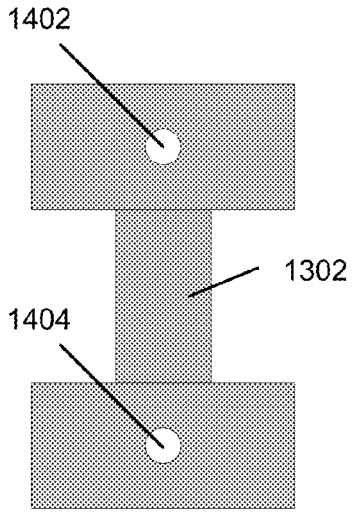
FIG. 14 is a front view of an embodiment of an attachment member for adding weight to an exercise device.

FIG. 14 is a front view of an embodiment of the attachment member 1302 for adding weight to the exercise device 100. The view of FIG. 14 shows that the attachment member 1302 can include a first hole 1402 and a second hole 1404. In an embodiment, the first hole 1402 can extend through the attachment member 1302 into the first opening 1304. Additionally, the second hole 1404 can extend through the attachment member 1302 into the second opening 1306. In this way, a securing component can be inserted into the first hole 1402 to couple the attachment member 1302 to additional weights or to a portion of the exercise device 100 via the first opening 1304. In other cases, a securing component can be inserted into the second hole 1404 to couple the attachment member 1302 to additional weights or to a portion of the exercise device 100 via the second opening 1306.

Figure 15:
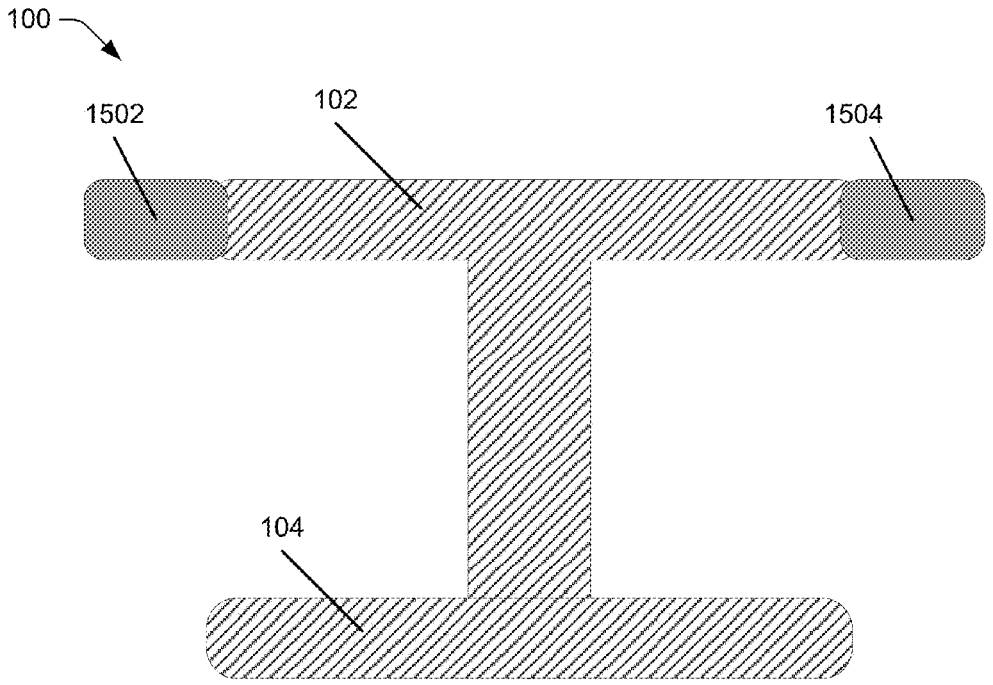
FIG. 15 is a front view of an embodiment of an exercise device that has weights attached to ends of a first bar member.

FIG. 15 is a front view of an embodiment of the exercise device 100 that has a first weight component 1502 attached to a first end of the first bar member 102 and a second weight component 1504 attached to a second end of the first bar member 104. In an embodiment, the first weight component 1502 and the second weight component 1504 can be coupled to the first bar member 102 via threaded openings on the ends of the first bar member 102. In some cases, the threaded openings can be formed by the first bar member 102 itself, such as threaded bores of the first bar member. In other cases, an insert can be joined to an end of the first bar member 102. In an illustrative embodiment, the first weight component 1502 and the second weight component 1504 can include a threaded portion that matches the threads of the opening in the first bar member 102 and the first weight component 1502 and the second weight component 1504 can be screwed into the threaded openings at the ends of the first bar member 102.

Figure 16:
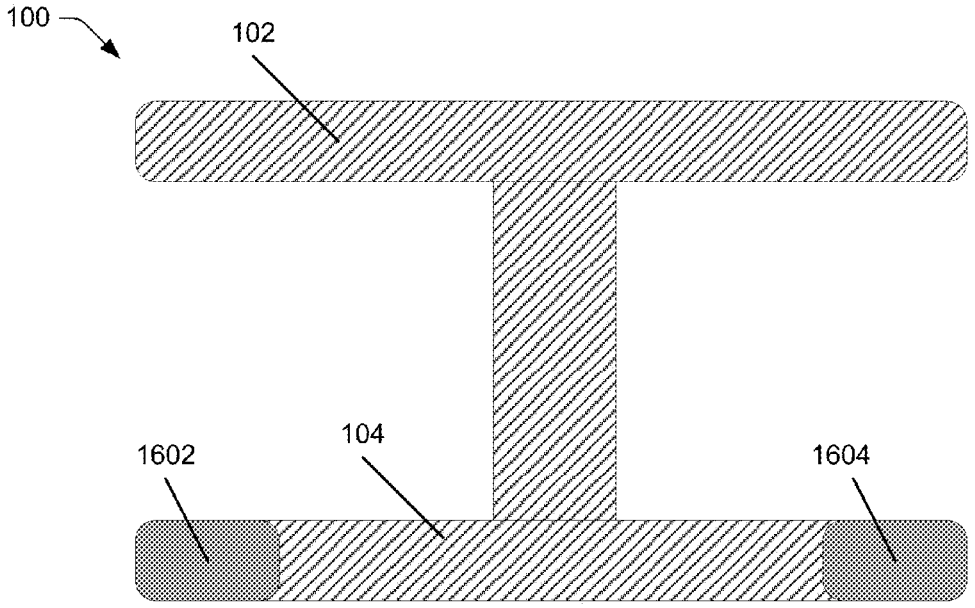
FIG. 16 is a front view of an embodiment of an exercise device that has weights attached to ends of a second bar member.

FIG. 16 is a front view of an embodiment of an exercise device that has a first weight component 1602 attached to an end of the second bar member 104 and a second weight component 1604 attached to an end of the second bar member 104. In an embodiment, the first weight component 1602 and the second weight component 1604 can be coupled to the second bar member 104 via threaded openings on the ends of the second bar member 104. In some cases, the threaded openings can be formed by the second bar member 104 itself, such as threaded bores of the second bar member 104. In other cases, an insert can be joined to an end of the second bar member 104. In an illustrative embodiment, the first weight component 1602 and the second weight component 1604 can include a threaded portion that matches the threads of the opening in the second bar member 104 and the first weight component 1602 and the second weight component 1604 can be screwed into the threaded openings at the ends of the second bar member 104.

Figure 17:
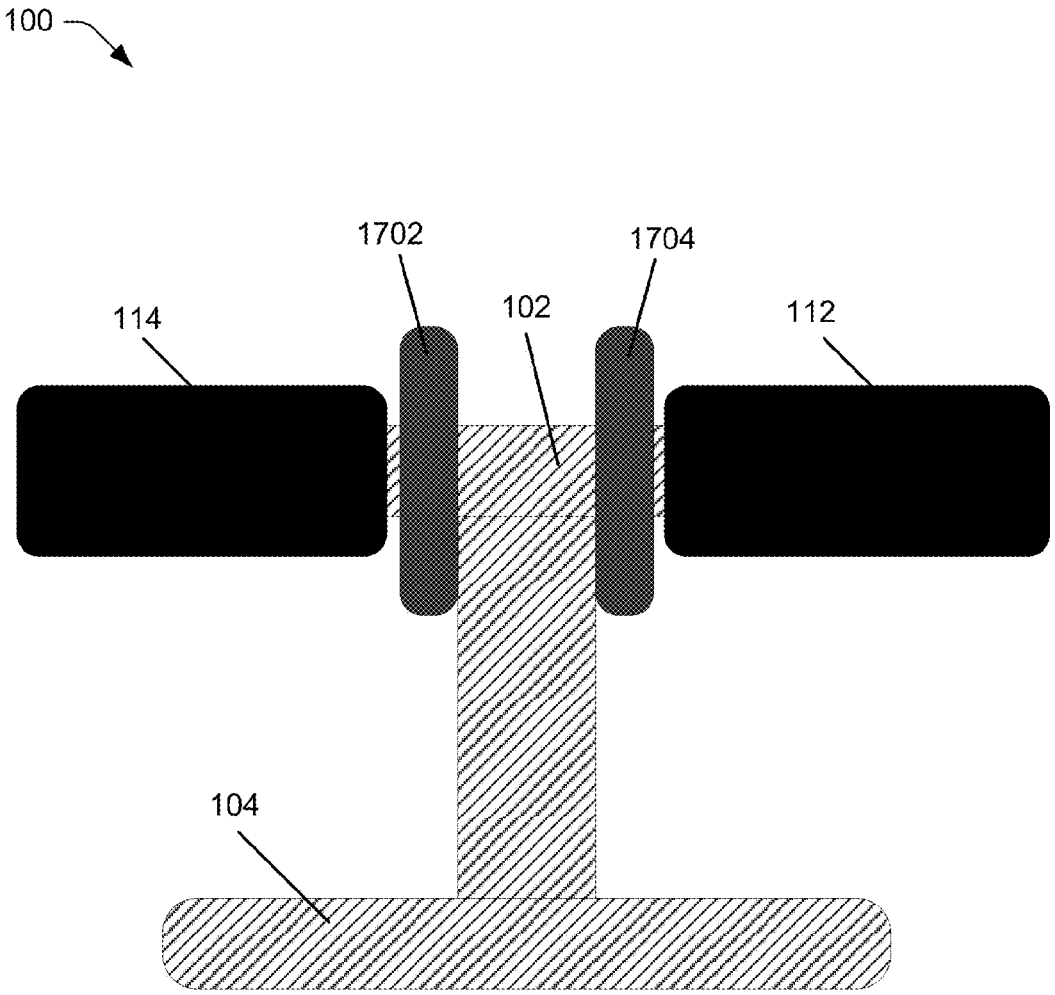
FIG. 17 is a front view of an embodiment of an exercise device that has free weights coupled to a first bar member.

FIG. 17 is a front view of an embodiment of the exercise device 100 that has free weights coupled to the first bar member 102. In an embodiment, a first weight component 1702 can be placed over a portion of the first bar member 102 and a second weight component 1704 can be placed over an additional portion of the first bar member 102. In various embodiments, the first weight component 1702 and the second weight component 1704 can have an inner diameter that is larger than an outer diameter of the first bar member 102. In some cases, the inner diameter of the first weight component 1702 and the inner diameter of the second weight component 1704 has a value that enables the first weight component 1702 and the second weight component 1704 to be placed on the first bar member 102 by sliding the first weight 1702 component and the second weight component 1704 along the first bar member 102 to a resting position.

In an embodiment, the first weight component 1702 can be held on the first bar member 102 using the pad 114 and the second weight component 1704 can be held on the first bar member 102 using the pad 112. In other embodiments, the first weight component 1702 and the second weight component 1704 can be held on the first bar member 102 by other components, such as one or more clamps and/or one or more collars. The first weight component 1702 and the second weight component 1704 can be removed from the first bar member 102 by removing the pad 112, the pad 114, and/or other clamps, collars, and the like from the first bar member 102. Although not shown in the illustrative example of FIG. 17, free weights can also be placed on and secured in a position on the lower bar 104 using one or more pads, one or more collars, one or more clamps, combinations thereof, and so forth.

Figure 18:
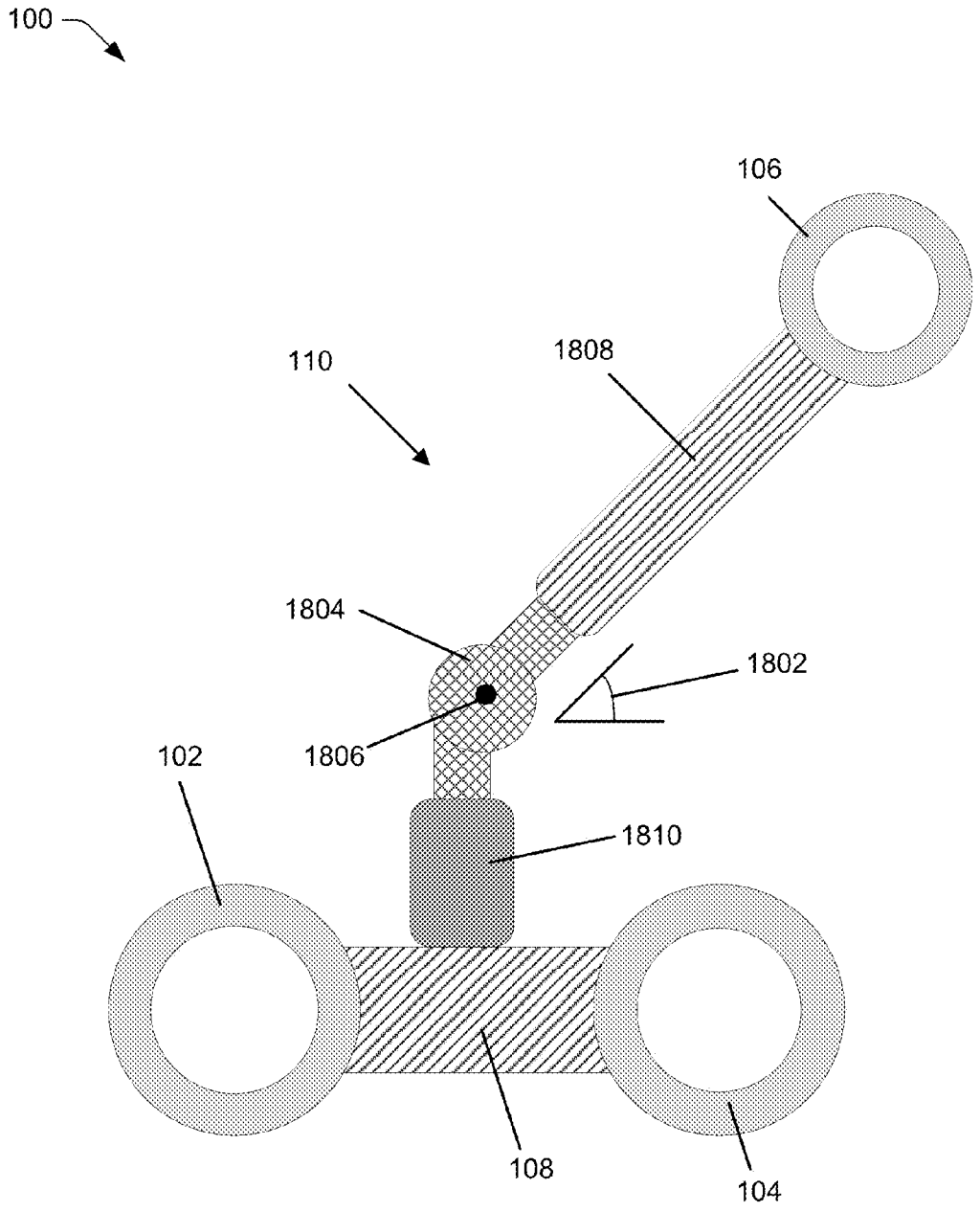
FIG. 18 is a side view of an embodiment of an exercise device that includes a rotatable connection member in a first position.

FIG. 18 is a side view of an embodiment of the exercise device 100 that includes an adjustable connection member in a first position. The exercise device 100 includes the first bar member 102, the second bar member 104, and the third bar member 106. Additionally, the exercise device 100 includes the first connection member 108 and the second connection member 110. In the illustrative example of FIG. 18, the second connection member 110 can be adjustable both to modify the length of the second connection member 110 and an angle 1802 at which the second connection member 110 is positioned. In the illustrative example of FIG. 18, the second connection member 110 can include a pivot component 1804 that can adjust the angle 1802 by rotating the second connection member 110 either toward the first bar member 102 or toward the second bar member 104. Rotating the second connection member 110 using the pivot component 1804 toward the first bar member 102 can increase the angle 1802, while rotating the second connection member 110 using the pivot component 1804 toward the second bar member 104 can decrease the angle 1802. In particular, the second connection member 110 can be rotated around an axis of rotation disposed through a center 1806 of the pivot component 1804.

In addition, the second connection member 110 can include an adjustable component 1808 that can be used to adjust the length of the second connection member 110. The adjustable component 1808 can be coupled to the third bar member 106. The adjustable component 1808 can include an outer portion having a number of holes and an inner portion that includes a push button that can slidably move along the second connection member 110 and engage one of the holes to set the length of the second connection member 110. The adjustable component 1808 can be coupled to the pivot component 1804. In some cases, the pivot component 1804 can have an outer diameter that is less than an inner diameter of the adjustable component 1808. In this way, a portion of the pivot component 1804 can fit within a portion of the adjustable component 1808. In some embodiments, the pivot component 1804 can have an outer diameter that is included in a range of about 0.4 inches to about 1.3 inches. The pivot component 1804 can be coupled to the adjustable component 1808 by one or more screws, one or more bolts, one or more pins, an adhesive, or a combination thereof.

The exercise device 100 also includes a securing component 1810 to couple the second connection member 110 to the first connection member 108. In some cases, the securing component 1810 can include a tee connector. In some cases, the pivot component 1804 can have an outer diameter that is less than an inner diameter of the securing component 1808. In this way, a portion of the pivot component 1804 can fit within a portion of the securing component 1810. The pivot component 1804 can be coupled to the securing component 1810 by one or more screws, one or more bolts, one or more pins, an adhesive, or a combination thereof.

Figure 19:
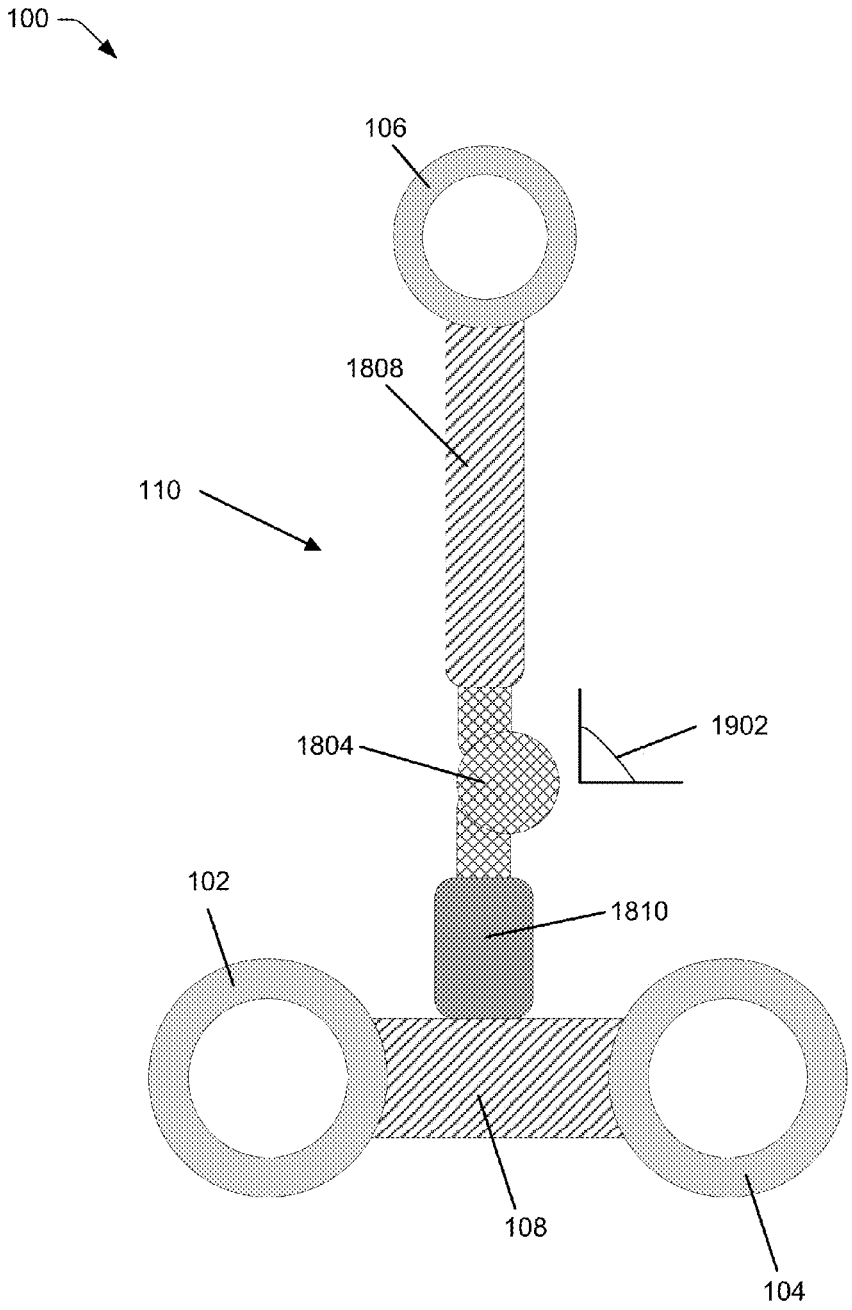
FIG. 19 is a side view of an embodiment of an exercise device that includes a rotatable connection member in a second position.

FIG. 19 is a side view of an embodiment of the exercise device 100 that includes the adjustable connection member 110 in a second position. The exercise device 100 includes the first bar member 102, the second bar member 104, and the third bar member 106. The exercise device 100 also includes the pivot component 1804, the adjustable component 1808, and the securing component 1810. In the illustrative example of FIG. 19, the second connection member 110 has been moved from the first position shown in FIG. 18 to the second position shown in in FIG. 19 by pivoting the second connection member 110 toward the first bar member 102 thereby producing an angle 1902 that is greater than the angle 1802 of FIG. 18.

By having the capability to adjust the angle at which the second connection member 110 is positioned and to adjust the length of the second connection member 110, an individual can modify the dimensions of the exercise device 100 such that the individual can comfortably perform exercises with the exercise device 100. Additionally, by having the capability to modify the dimensions of the exercise device 100, an individual can perform exercises that strengthen different muscles based on the different modifications made to the exercised device 100.

Figure 20:
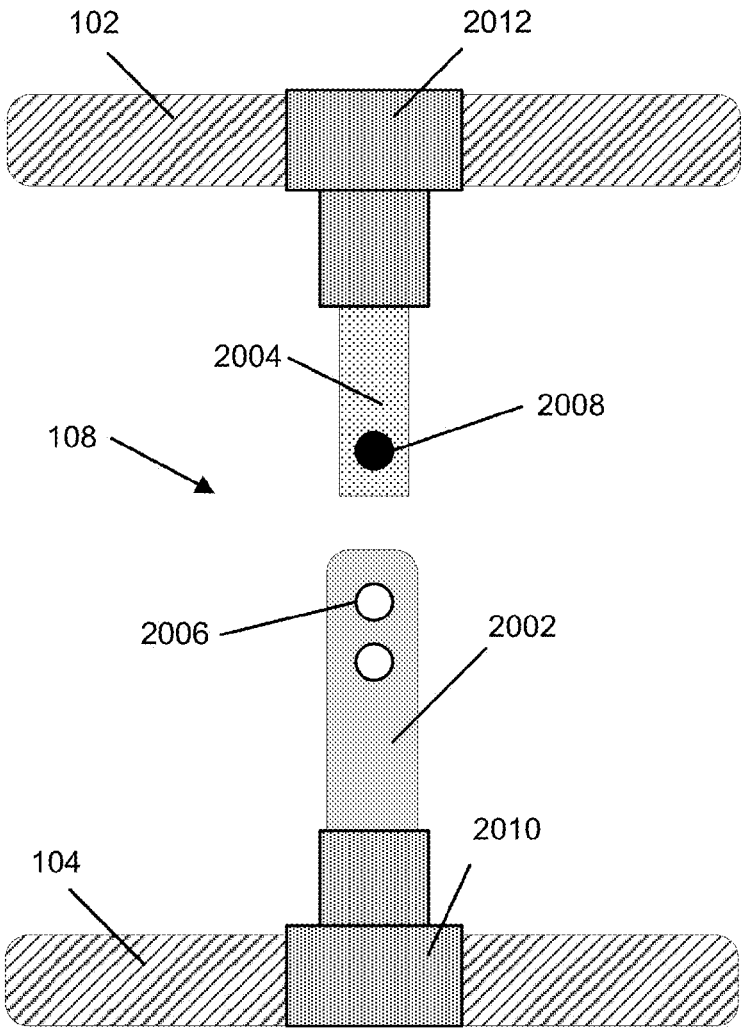
FIG. 20 is a view of an embodiment of an exercise device having an adjustable first connection member.

FIG. 20 is a view of an embodiment of the exercise device 100 having an adjustable first connection member. In the illustrative example of FIG. 20, the first connection member 108 can include a number of components that enable the distance between the first bar member 102 and the second bar member 104 to be adjusted. To illustrate, the first connection member 108 includes an outer component 2002 and an inner component 2004. The outer component 2002 can include one or more holes 2006 and the inner component 2004 can include a push button 2012. Additionally, the outer component 2002 can have an inner diameter that is greater than an outer diameter of the inner component 2004. In this way, the inner component 2004 can be inserted into the outer component 2002 and the push button 2008 can engage with one of the holes 2006 to set a length of the first connection member 108. The length of the first connection member 108 can be further adjusted by disengaging the push button 2008 from one of the holes 2006 and engaging the push button 2008 with an additional hole 2006. Although, the illustrative example of FIG. 20 shows the outer component 2002 with two holes, the outer component 2002 can have a different number of holes 2006, such as three holes, four holes, or five holes.

In an illustrative example, the outer component 2002 can have a length included in a range of about 2 inches to about 10 inches. In an additional illustrative example, the outer component 2002 can have a length included in a range of about 3 inches to about 7 inches. In another illustrative example, the inner component 2004 can have a length included in a range of about 3 inches to about 12 inches. In a further illustrative example, the inner component 2004 can have a length included in a range of about 4 inches to about 8 inches.

Additionally, the outer component 2002 can be coupled to the second bar member 104 using a first securing component 2010 and the inner component 2002 can be coupled to the first bar member 102 using a second securing component 2012. In an embodiment, the portion of the first securing component 2010 joining the outer component 2002 with the second bar member 104 can have an inner diameter that is greater than an outer diameter of the outer component 2002. In this way, the outer component 2002 can be engaged inside of the first securing component 2010. The outer component 2002 can be coupled to the first securing component 2010 using one or more fastening devices, such as one or more screws, one or more pins, one or more bolts, an adhesive, or a combination thereof. In a particular embodiment, the first securing component 2010 can include a tee connector.

Further, in an embodiment, the portion of the second securing component 2012 joining the inner component 2004 with the first bar member 102 can have an inner diameter that is greater than an outer diameter of the inner component 2004. In this way, the inner component 2004 can be engaged inside of the second securing component 2012. The inner component 2004 can be coupled to the second securing component 2012 using one or more fastening devices, such as one or more screws, one or more pins, one or more bolts, an adhesive, or a combination thereof. In a particular embodiment, the second securing component 2012 can include a tee connector.

Figure 21:
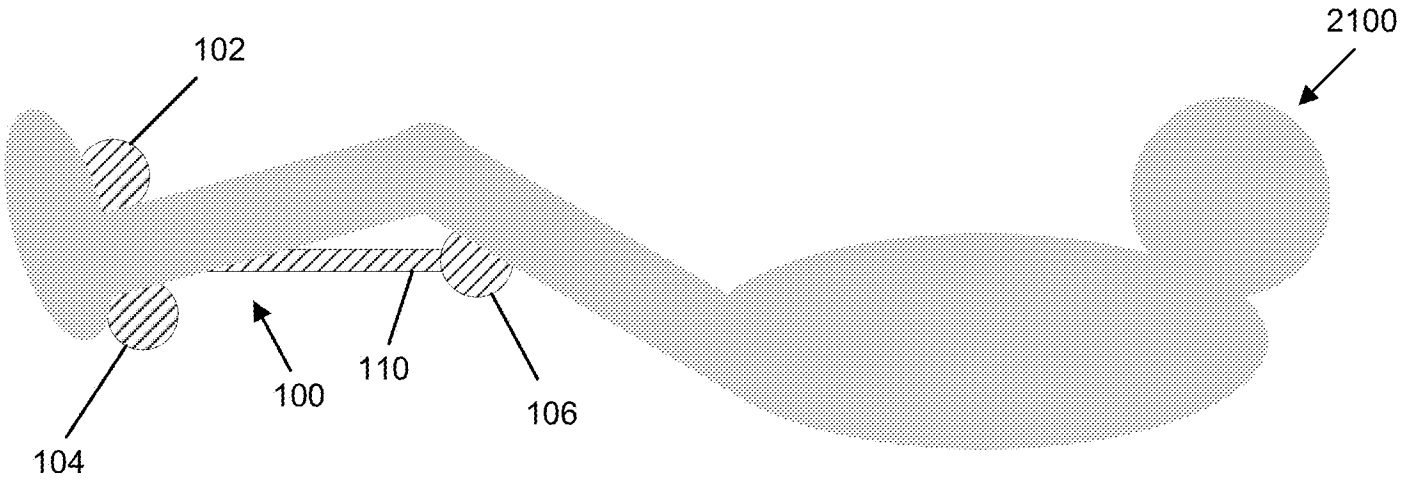
FIG. 21 is a view of an individual in a first position using an embodiment of an exercise device to perform an exercise.

FIG. 21 is a view of an individual 2100 in a first position using an embodiment of the exercise device 100 to perform an exercise. In particular, the exercise device 100 is positioned such that the ankles of the individual 2100 are disposed between the first bar member 102 and the second bar member 104. The third bar member 106 is resting against the thigh of the individual 2100 with the second connection member 110 shown coupling the third bar member 106 to the first bar member 102 and the second bar member 104. The individual 2100 can be lying with their back against the floor or against an exercise bench. Although not shown in FIG. 21, the exercise device 100 can be coupled to an exercise apparatus that includes weights. In this situation, the weights of the exercise apparatus can add to the exertion by the individual 2100 to move the exercise device 100 and further strengthen muscles of the individual 2100, particularly abdominal muscles of the individual 2100. In some cases, additional weights can be directly coupled to the exercise device 100, as described previously with respect to FIGS. 13-17, thereby increasing the exertion by the individual 2100 to move the exercise device 100 and further strengthen muscles of the individual.

Figure 22:
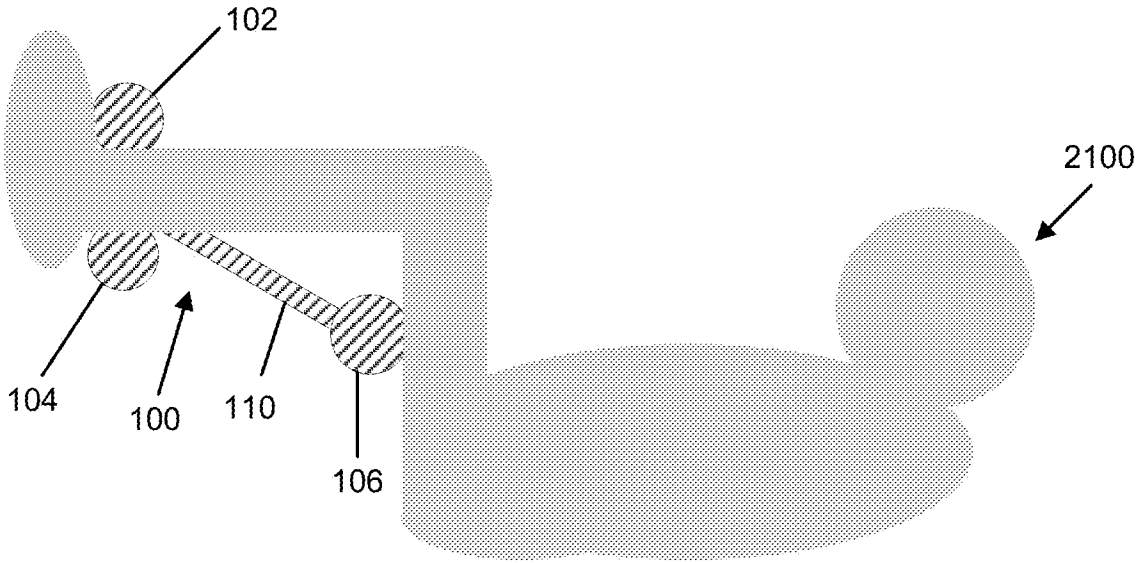
FIG. 22 is a view of an individual in a second position using an embodiment of an exercise device to perform an exercise.

FIG. 22 is a view of the individual 2100 in a second position using an embodiment of the exercise device 100 to perform an exercise. In particular, the individual 2100 has drawn their legs closer to their chest. As the individual 2100 moves from the first position of FIG. 21 to the second position of FIG. 22, the ankles of the individual 2100 continue to be disposed between the first bar member 102 and the second bar member 104. Additionally, the third bar member 106 continues to rest against the thigh of the individual 2100. By moving from the first position of FIG. 21 to the second position of FIG. 22 using the exercise device 100, muscles of the individual 2100 are strengthened due to the exertion by the individual 2100 to move the exercise device 100 to the second position.

Figure 23:
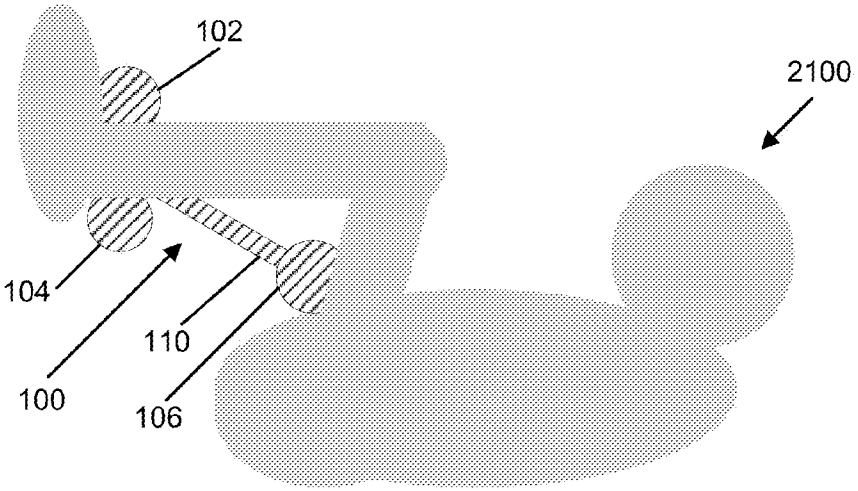
FIG. 23 is a view of an individual in a third position using an embodiment of an exercise device to perform an exercise.

FIG. 23 is a view of the individual 2100 in a third position using an embodiment of the exercise device 100 to perform an exercise. In particular, the individual 2100 has drawn their legs closer into their chest than when the individual 2100 was in the second position shown in FIG. 22. In some cases, the progression of the individual 2100 from the first position in FIG. 21 to the second position of FIG. 22 to the third position of FIG. 23 can be a part of the same exercise that is performed to strengthen muscles of the individual 2100. As the individual 2100 moves from the second position of FIG. 22 to the third position of FIG. 23, the ankles of the individual 2100 continue to be disposed between the first bar member 102 and the second bar member 104. Additionally, the third bar member 106 continues to rest against the thigh of the individual 2100.

By utilizing the exercise device 100, the individual 2100 can achieve improved strengthening of muscles of the body, and particularly improved abdominal muscle strengthening, in relation to conventional techniques and conventional exercise devices. For example, an individual 2100 using the exercise device 100 can isolate muscles of the abdominal wall including the obliques with a single device and performing a single exercise. In addition, the muscles of the lower back are supported when exercises are performed using the exercise device 100, which can decrease pain in the lower back during and/or after performing abdominal muscle strengthening exercises, such as reverse crunches. Furthermore, the exercise device 100 is adjustable to fit different body types and sizes. The exercise device 100 can also utilize a separate exercise apparatus, or any of a variety of types of weights that can be used to increase exertion during the performance of exercises using the exercise device, such as hand weights, ankle weights, resistance bands, free weights, and the like. When the exercise device 100 is attached to a separate exercise apparatus, in some cases, the exercise apparatus can include one or more pulleys with weights attached to a first end of the one or more pulleys, while the exercise device 100 is attached to another end of the one or more pulleys. In this way, additional resistance can be utilized when performing exercises with the exercise device 100 attached to the weights of the exercise apparatus because the weights can be raised and lowered as the individual 2100 moves the exercise device 100 closer to and away from their body.

In some cases, exercises performed using the exercise device 100 can be performed while the individual 2100 is laying on the ground. In other cases, exercises performed using the exercise device 100 can be performed while the individual 2100 is laying on an elevated exercise bench. In some cases, the exercise bench can be substantially flat, while in other scenarios, the exercise bench can be disposed at an angle. By using an elevated exercise bench to perform exercises using the exercise device 100, a greater range of motion can be achieved by the legs of the individual 2100 and additional muscles of the individual 2100 can be strengthened. Additionally, during exercises performed using the exercise device 100, the individual 2100 can grip an object, such as an exercise bench, a bar resting on a weight bench, a structure of an exercise apparatus, and the like. In other instances, the arms of the individual 2100 can be placed at their side while performing exercises using the exercise device 100.

Thus, using the exercise device 100 described according to embodiments herein can be used to perform a wide variety of exercises that are not achievable using a conventional exercise device. Accordingly, the exercise device 100 provides the individual 2100 with not only improved strengthening of muscles, particular abdominal muscles, during the use of the exercise device 100, but flexibility in the number of exercises performed using the exercise device 100 and the types of exercises performed using the exercise device 100.

This disclosure provides various example embodiments, as described and as illustrated in the drawings. However, this disclosure is not limited to the embodiments described and illustrated herein, but can extend to other embodiments, as would be known or as would become known to those skilled in the art. Reference in the specification to "one embodiment," "this embodiment," "these embodiments" or "some embodiments" means that a particular feature, structure, or characteristic described is included in at least one embodiment, and the appearances of these phrases in various places in the specification are not necessarily all referring to the same embodiment.

What is claimed is:

1. An exercise device comprising:

a first bar member disposed along a first horizontal axis;

a first connection member coupled to the first bar member at a first end portion of the first connection member, the first connection member being disposed along a vertical axis that is substantially perpendicular to the first horizontal axis;

a second bar member coupled to a second end portion of the first connection member, the second bar member disposed along a second horizontal axis that is substantially parallel with the first horizontal axis;

a first securing component including a tee connector;

a second connection member coupled to the first connection member using the first securing component at a first end portion of the second connection member and between the first end portion of the first connection member and the second end portion of the first connection member, the second connection member (i) having a length that is adjustable using an adjustable component, and (ii) including a pivot component coupled between the first securing component and the adjustable component, wherein:

the first securing component couples the first connection member to the second connection member;

the pivot component is configured to rotate the second connection member around an axis of rotation disposed through the center of the pivot component;

the pivot component is coupled to the adjustable component by one or more screws, one or more bolts, one or more pins, or a combination thereof; and the axis of rotation is substantially parallel to the first horizontal axis and substantially parallel to the second horizontal axis;

and a third bar member coupled to a second end portion of the second connection member using a second securing component, the third bar member being disposed along a third horizontal axis that is substantially parallel to the first horizontal axis and substantially parallel to the second horizontal axis.

2. The exercise device of claim 1, further comprising:

a first pad disposed on a first end portion of the first bar member;

a second pad disposed on a second end portion of the first bar member;

a third pad disposed on a first end portion of the second bar member;

a fourth pad disposed on a second end portion of the second bar member; and wherein the first connection member is coupled to the first bar member between the first end portion of the first bar member and the second end portion of the first bar member and the first connection member is coupled to the second bar member between the first end portion of the second bar member and the second end portion of the second bar member.

3. The exercise device of claim 2, further comprising:

a fifth pad disposed on a first end portion of the third bar member;

a sixth pad disposed on a second end portion of the third bar member; and wherein the second connection member is coupled to the third bar member between the first end portion of the third bar member and the second end portion of the third bar member.

4. The exercise device of claim 1, wherein:

the second connection member includes an outer component;

the outer component of the second connection member includes a plurality of holes and the inner component of the second connection member includes a push button; and the inner component of the second connection member is at least partially disposed inside of the outer component of the second connection member such that the push button engages one of the holes of the outer component of the second connection member.

5. An exercise device comprising:

a first bar member disposed along a first horizontal axis;

a first connection member coupled to the first bar member and being disposed along a vertical axis that is substantially perpendicular to the first horizontal axis;

a second bar member coupled to the first connection member, the second bar member disposed along a second horizontal axis that is substantially parallel with the first horizontal axis;

a second connection member coupled to the first connection member, the second connection member (i) including an adjustable component to adjust a length of the second connection member, and (ii) including a pivot component coupled between a securing component and the adjustable component, wherein:

the securing component couples the first connection member to the second connection member;

the pivot component is configured to rotate the second connection member around an axis of rotation disposed through the center of the pivot component; and the axis of rotation is substantially perpendicular to a third horizontal axis, substantially parallel to the first horizontal axis, and substantially parallel to the second horizontal axis;

a third bar member coupled to the second connection member, the third bar member being disposed along the third horizontal axis that is substantially parallel to the first horizontal axis and substantially parallel to the second horizontal axis; and an attachment coupled to the first bar member, the first connection member, or the second connection member via a first opening of the attachment, the attachment including a weight component disposed in a second opening of the attachment, and the first opening and the second opening are disposed on opposite ends of the attachment.

6. The exercise device of claim 5, wherein the first bar member, the second bar member, the third bar member, or a combination thereof include a metal or a plastic.

7. The exercise device of claim 5, wherein:

a width of the first bar member is included in a range of about 10 inches to about 20 inches;

a width of the third bar member is included in a range of about 9 inches to about 18 inches;

a height of the first connection member is included in a range of about 2 inches to about 10 inches; and the length of the second connection member is included in a range of about 6 inches to about 21 inches.

8. The exercise device of claim 5, wherein the length of the second connection member is adjustable.

9. The exercise device of claim 5, wherein:

the first portion of the first bar member includes a first end portion of the first bar member and a second portion of the first bar member includes a second end portion of the first bar member.

10. The exercise device of claim 5, wherein the pivot component is configured to rotate the second connection member to adjust an angle at which the second connection member is positioned.

11. The exercise device of claim 5, further comprising an anchor coupled to the first connection member.

* * * * *